US009839909B2

(12) United States Patent
Lee et al.

(10) Patent No.: US 9,839,909 B2
(45) Date of Patent: Dec. 12, 2017

(54) DEVICE, SYSTEM AND METHOD FOR PROCESSING A SAMPLE

(75) Inventors: Helen Hwai-an Lee, Cambridge (GB); Magda Anastassova Dineva, Cambridge (GB); Craig Alan Wisniewski, Cambridge (GB); Phillip John Stankus, West Sussex (GB)

(73) Assignees: Diagnostics for the Real World, Ltd., Sunnyvale, CA (US); Cambridge Enterprise Limited, Cambridge (GB)

( * ) Notice: Subject to any disclaimer, the term of this patent is extended or adjusted under 35 U.S.C. 154(b) by 40 days.

(21) Appl. No.: 12/375,335

(22) PCT Filed: Jul. 27, 2007

(86) PCT No.: PCT/GB2007/002854

§ 371 (c)(1),
(2), (4) Date: Sep. 29, 2009

(87) PCT Pub. No.: WO2008/012550

PCT Pub. Date: Jan. 31, 2008

(65) Prior Publication Data

US 2010/0028204 A1 Feb. 4, 2010

(30) Foreign Application Priority Data

Jul. 28, 2006 (GB) ..... 0615109.6
Jul. 28, 2006 (GB) ..... 0615110.4

(51) Int. Cl.
*B01L 3/00* (2006.01)
*B01L 7/00* (2006.01)

(52) U.S. Cl.
CPC ..... *B01L 3/502* (2013.01); *B01L 3/5027* (2013.01); *B01L 7/00* (2013.01); *B01L 2200/04* (2013.01);
(Continued)

(58) Field of Classification Search
CPC ..... B01L 3/502; B01L 2200/16; B01L 7/00; B01L 2200/04; B01L 2200/0621;
(Continued)

(56) References Cited

U.S. PATENT DOCUMENTS 3,660,033 A 5/1972 Schwartz
3,689,224 A 9/1972 Agnew et al.
(Continued)

FOREIGN PATENT DOCUMENTS

DE 103 31 108 2/2005
EP 0 291 194 B1 11/1988
(Continued)

OTHER PUBLICATIONS

Notification of Transmittal of the International Search Report and the Written Opinion of the International Searching Authority, or the Declaration, PCT/GB2007/002854 dated Mar. 17, 2008.
(Continued)

*Primary Examiner* — Lore Jarrett
(74) *Attorney, Agent, or Firm* — Daly, Crowley, Mofford & Durkee, LLP

(57) ABSTRACT

A device for the processing of a sample comprises a location apparatus, a processing chamber for receiving the sample and a plurality of reagent chambers. The reagent chambers have openings defined in the location apparatus. The processing chamber is movable relative to the reagent chambers to enable sequential communication with each reagent chamber in turn.

26 Claims, 29 Drawing Sheets

Figure 1A:
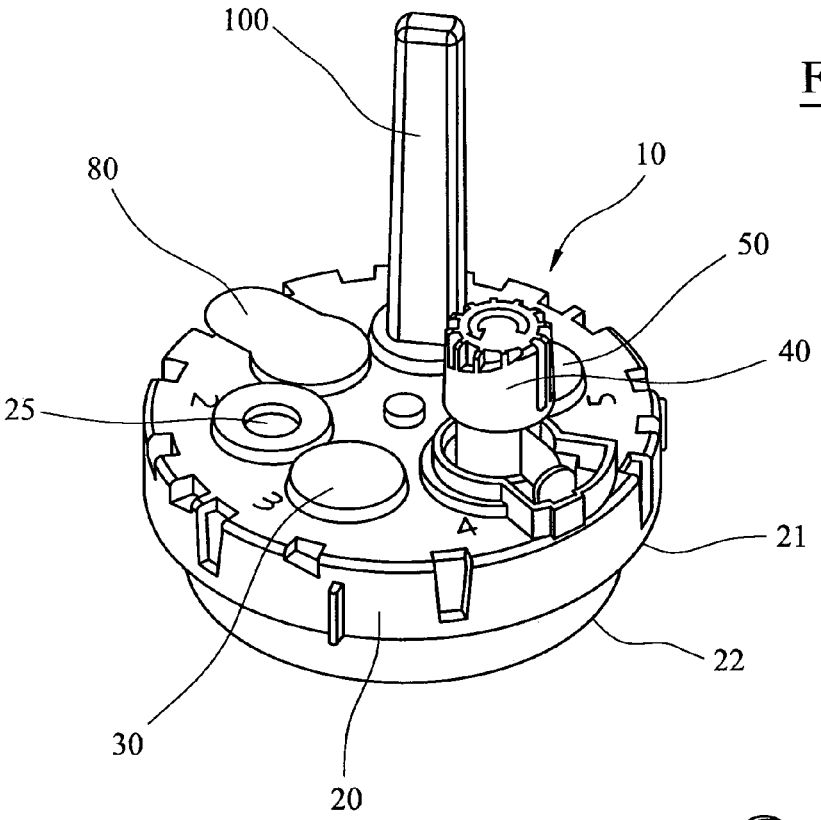

(52) U.S. Cl.
CPC ... *B01L 2200/0621* (2013.01); *B01L 2200/16* (2013.01); *B01L 2300/045* (2013.01); *B01L 2300/0663* (2013.01); *B01L 2300/0816* (2013.01); *B01L 2300/0861* (2013.01); *B01L 2400/0478* (2013.01); *B01L 2400/0644* (2013.01)

(58) Field of Classification Search
CPC ..... B01L 2400/0644; B01L 3/5027; B01L 2300/0663; B01L 2300/0816; B01L 2300/0861; B01L 2400/0478; B01L 2300/045
See application file for complete search history.

(56) References Cited

U.S. PATENT DOCUMENTS 3,713,779 A 1/1973 Sirago et al.
4,065,263 A 12/1977 Woodbridge, III
4,765,810 A 8/1988 Wetzel
4,795,265 A 1/1989 Dahlberg et al.
4,978,502 A 12/1990 Dole et al.
4,978,602 A 12/1990 Fujita et al.
5,035,996 A 7/1991 Hartley
5,089,233 A 2/1992 DeVaney, Jr. et al.
5,096,669 A 3/1992 Lauks et al.
5,116,576 A 5/1992 Stanley
5,154,888 A 10/1992 Zander et al.
5,229,297 A 7/1993 Schnipelsky et al.
5,267,648 A 12/1993 Baker
5,288,463 A 2/1994 Chemelli
5,310,523 A * 5/1994 Smethers et al. ..... 422/404
5,422,271 A 6/1995 Chen et al.
5,460,780 A 10/1995 Devaney, Jr. et al.
5,538,849 A 7/1996 Uematsu et al.
5,599,501 A 2/1997 Carey et al.
5,602,040 A 2/1997 May et al.
5,604,101 A 2/1997 Hanley et al.
5,622,871 A 4/1997 May et al.
5,645,801 A 7/1997 Bouma et al.
5,656,503 A 8/1997 May et al.
5,714,380 A 2/1998 Neri et al.
5,714,389 A 2/1998 Charlton et al.
5,725,831 A 3/1998 Reichler et al.
5,783,148 A 7/1998 Cottingham et al.
5,811,296 A 9/1998 Chemelli et al.
5,824,216 A 10/1998 Joie et al.
5,827,478 A 10/1998 Carey et al.
5,843,793 A 12/1998 Belly et al.
5,849,544 A 12/1998 Harris et al.
5,863,502 A 1/1999 Southgate et al.
5,910,138 A 6/1999 Sperko et al.
5,922,288 A 7/1999 Herst
5,922,591 A 7/1999 Anderson et al.
5,935,858 A 8/1999 Herst
5,948,673 A 9/1999 Cottingham
5,955,351 A 9/1999 Gerdes et al.
5,989,499 A 11/1999 Catanzariti et al.
5,989,921 A 11/1999 Charlton et al.
6,007,529 A 12/1999 Gustafsson et al.
6,043,080 A 3/2000 Lipshutz et al.
6,077,711 A 6/2000 Singer
6,153,425 A 11/2000 Kozwich et al.
6,162,602 A 12/2000 Gautsch
6,187,598 B1 2/2001 May et al.
6,228,660 B1 5/2001 May et al.
6,247,617 B1 6/2001 Clyde et al.
6,251,660 B1 6/2001 Muir et al.
6,300,068 B1 10/2001 Burg et al.
6,300,142 B1 10/2001 Andrewes et al.
6,318,191 B1 11/2001 Chen
6,319,243 B1 11/2001 Becker et al.
6,395,227 B1 5/2002 Kiser et al.
6,398,771 B1 6/2002 Gustafsson et al.
6,410,275 B1 6/2002 Kluttz et al.
6,426,230 B1 7/2002 Feistel
6,429,007 B1 8/2002 Kluttz et al.
6,468,377 B1 10/2002 Sperko et al.
6,485,982 B1 11/2002 Charlton
6,565,808 B2 5/2003 Hudak et al.
6,586,234 B1 7/2003 Burg et al.
6,645,758 B1 11/2003 Schnipelsky et al.
6,649,378 B1 11/2003 Kozwich et al.
6,663,743 B1 12/2003 Becker et al.
6,713,298 B2 3/2004 McDevitt et al.
6,748,332 B2 6/2004 Chen
6,764,567 B2 7/2004 Sperko et al.
6,780,617 B2 8/2004 Chen
6,818,455 B2 11/2004 May et al.
6,846,305 B2 1/2005 Smith et al.
6,872,566 B2 3/2005 Vischer et al.
6,921,639 B2 7/2005 Vischer
6,949,376 B2 9/2005 Kluttz et al.
6,964,862 B2 11/2005 Chen
6,996,951 B2 2/2006 Smith et al.
7,033,761 B2 4/2006 Shafer
7,109,042 B2 9/2006 May et al.
7,169,138 B2 1/2007 Becker et al.
7,175,614 B2 2/2007 Gollier et al.
7,214,529 B2 5/2007 Kluttz et al.
7,241,417 B2 7/2007 Lee et al.
7,270,959 B2 9/2007 Hudak
7,544,324 B2 6/2009 Tung et al.
7,560,272 B2 7/2009 Ramsey et al.
7,758,815 B2 7/2010 Hartselle
7,767,447 B2 8/2010 Breidenthal et al.
8,017,340 B2 9/2011 Collier et al.
8,018,593 B2 9/2011 Tan et al.
8,062,884 B2 11/2011 Sarofim
8,133,703 B2 3/2012 Ching et al.
8,182,747 B2 5/2012 Marquant et al.
8,394,608 B2 3/2013 Ririe et al.
2002/0086309 A1 7/2002 Benn et al.
2003/0012697 A1 1/2003 Hahn et al.
2003/0049833 A1 3/2003 Chen et al.
2003/0073089 A1 4/2003 Mauze et al.
2003/0186295 A1 10/2003 Colin et al.
2003/0224371 A1 12/2003 Thomas et al.
2004/0161788 A1 8/2004 Chen et al.
2004/0171170 A1* 9/2004 Sandell ..... 436/180
2004/0223878 A1 11/2004 Chen
2004/0248087 A1 12/2004 Burg et al.
2005/0009203 A1 1/2005 Wong
2005/0153430 A1 7/2005 Ohtaka
2005/0161377 A1 7/2005 Fujimoto et al.
2005/0244308 A1 11/2005 Tanaami et al.
2005/0244837 A1 11/2005 McMillan
2005/0244887 A1 11/2005 Kluttz et al.
2006/0019273 A1 1/2006 Connolly et al.
2006/0023039 A1 2/2006 Padmanabhan et al.
2006/0030038 A1 2/2006 Taylor et al.
2006/0040405 A1 2/2006 Charlton et al.
2006/0154341 A1 7/2006 Chen
2006/0160078 A1 7/2006 Cardy et al.
2006/0263871 A1 11/2006 Kluttz et al.
2007/0065225 A1 3/2007 Moore
2007/0154355 A1 7/2007 Berndt et al.
2007/0154922 A1 7/2007 Collier et al.
2007/0184547 A1 8/2007 Handique et al.
2008/0153078 A1 6/2008 Braman et al.
2008/0166279 A1 7/2008 Tanaami et al.
2009/0017554 A1 1/2009 Vann
2009/0074624 A1 3/2009 Liang
2009/0227006 A1 9/2009 Kopp et al.
2010/0003683 A1 1/2010 Sarofim et al.
2010/0028204 A1 2/2010 Lee et al.
2010/0144541 A1 6/2010 Murasato et al.
2011/0104731 A1 5/2011 Teng et al.
2011/0244466 A1 10/2011 Juncosa et al.
2012/0040468 A1 2/2012 Khaled

(56) References Cited

U.S. PATENT DOCUMENTS

FOREIGN PATENT DOCUMENTS

| | | | |
|---|---|---|---|
| EP | 0 349 215 | B1 | 1/1990 |
| EP | 0 381 501 | A2 | 8/1990 |
| EP | 0 402 994 | A2 | 12/1990 |
| EP | 0 402 995 | A2 | 12/1990 |
| EP | 0533801 | A1 | 3/1993 |
| EP | 0 560 410 | B1 | 9/1993 |
| EP | 0 560 411 | B1 | 9/1993 |
| EP | 0 606 961 | B1 | 7/1994 |
| EP | 0 656 068 | B1 | 6/1995 |
| EP | 0 712 000 | | 5/1996 |
| EP | 0 838 025 | B1 | 4/1998 |
| EP | 0 875 291 | A2 | 11/1998 |
| EP | 0 898 466 | B1 | 3/1999 |
| EP | 1 146 961 | B1 | 10/2001 |
| EP | 1 146 963 | B1 | 10/2001 |
| EP | 1 161 932 | B1 | 12/2001 |
| EP | 1 248 112 | A2 | 10/2002 |
| EP | 1 295 949 | A1 | 3/2003 |
| EP | 1 371 419 | | 12/2003 |
| EP | 0 541 715 | B2 | 6/2004 |
| EP | 1 555 529 | A2 | 7/2005 |
| EP | 1 614 464 | | 1/2006 |
| EP | 1 614 464 | A | 1/2006 |
| EP | 1 614 464 | A1 | 1/2006 |
| EP | 1 792 654 | A2 | 6/2007 |
| EP | 1 798 556 | A1 | 6/2007 |
| EP | 2 279 790 | | 2/2011 |
| FR | 2 609 334 | | 7/1988 |
| GB | 2 283 318 | A | 5/1995 |
| GB | 2 455 204 | | 6/2009 |
| WO | WO 91/16086 | | 10/1991 |
| WO | WO 91/19567 | | 12/1991 |
| WO | WO 91/19567 | A | 12/1991 |
| WO | WO 94/02634 | | 2/1994 |
| WO | WO 98/40466 | | 9/1998 |
| WO | WO 98/54580 | | 12/1998 |
| WO | WO 98/54580 | A | 12/1998 |
| WO | WO 99/28038 | | 6/1999 |
| WO | WO 99/28038 | A | 6/1999 |
| WO | WO 99/67646 | | 12/1999 |
| WO | WO 01/41930 | | 6/2001 |
| WO | WO 01/41930 | A | 6/2001 |
| WO | WO 01/41930 | A1 | 6/2001 |
| WO | WO 02/057798 | A2 | 7/2002 |
| WO | WO 03/022435 | A2 | 3/2003 |
| WO | WO 2004/012862 | A2 | 2/2004 |
| WO | WO 2004/012862 | A3 | 2/2004 |
| WO | WO 2004/080597 | A2 | 9/2004 |
| WO | WO 2005/005044 | A1 | 1/2005 |
| WO | WO 2005/121963 | A2 | 12/2005 |
| WO | WO 2006/018044 | | 2/2006 |
| WO | WO 2006/018044 | A | 2/2006 |
| WO | WO 2006/018044 | A1 | 2/2006 |
| WO | WO 2006/121997 | A2 | 11/2006 |
| WO | WO 2006/136990 | | 12/2006 |
| WO | WO 2008/012550 | | 1/2008 |
| WO | WO 2008/012550 | A2 | 1/2008 |
| WO | WO 2009/024773 | A1 | 2/2009 |

OTHER PUBLICATIONS

Notification of International Preliminary Report on Patentability and Written Opinion of the International Searching Authority for PCT/GB2007/002854, dated Feb. 12, 2009, 9 pages.
Guatelli, et al.; Isothermal, in vitro amplification of nucleic acids by a multienzyme reaction modeled after retroviral replication; Proc. Natl. Acad. Sci.; Vo. 87; Mar. 1990; pp. 1874-1878.
PCT International Preliminary Report on Patentability and Written Opinion of the ISA for PCT/GB2008/002802 dated Mar. 4, 2010; 10 pages.
PCT Search Report of the ISA for PCT/GB2008/002802 dated Dec. 30, 2008; 3 pages.
Search Report of the GB IPO for GB/0716156.5 dated Apr. 28, 2008; 2 pages.
Further Search Report of the GB IPO for GB0716156.5 dated Jul. 7, 2008; 8 pages.
Chiou; "DNA-Scission Activities of Ascorbate in the Presence of Metal Chelates;" J. Biochem, vol. 96, No. 4, 1984; pp. 1307-1310.
Compton; "Nucleic Acid Sequence-based amplification;" Nature, vol. 350, Mar. 7, 1991; pp. 91-92.
Sigman, et al.; "Oxygen-dependent Cleavage of DNA by the 1,10-Phenanthroline Cuprous Complex;" The Journal of Biological Chemistry, vol. 254, No. 24, Dec. 1979; pp. 12269-12272.
Office Action dated Dec. 28, 2012; for U.S. Appl. No. 12/673,989; 18 pages.
Response filed Jun. 25, 2013; for Office Action dated Dec. 28, 2012; for U.S. Appl. No. 12/673,989; 13 pages.
Office Action dated Jul. 12, 2012; for U.S. Appl. No. 12/673,939; 8 pages.
Response filed Jan. 13, 2014 to Final Office Action dated Jul. 12, 2013; for U.S. Appl. No. 12/673,939; 13 pages.
Office Action dated Feb. 29, 2016; For U.S. Appl. No. 12/673,939; 11 pages.
Response filed Aug. 23, 2016; to Office Action dated Feb. 29, 2016; for U.S. Appl. No. 12/673,939; 12 pages.
European Examination Report dated May 6, 2009 for European Application No. 0904302.7; 3 pages.
European Response to Examination Report filed Sep. 7, 2009 for European Application No. 0904302.7; 10 pages.
European Examination Report dated Sep. 24, 2009 for European Application No. 0904302.7; 3 pages.
European Response to Examination Report filed Nov. 24, 2009 for European Application No. 0904302.7; 12 pages.
European Examination Report dated Dec. 24, 2009 for European Application No. 0904302.7; 3 pages.
European Response to Examination Report filed Feb. 24, 2010 for European Application No. 0904302.7; 17 pages.
English Translation of Chinese Office Action dated Apr. 19, 2011 for Chinese Application No. 200780036383.6; 4 pages.
English Translation of Chinese Office Action dated Apr. 19, 2012 for Chinese Application No. 200780036383.6; 1 page.
English Translation of Decision of Rejection dated Nov. 26, 2012 for Chinese Application No. 200780036383.6; 3 pages.
English Translation of Chinese Office Action dated Mar. 27, 2014 for Chinese Application No. 200780036383.6; 3 pages.
English Translation of Chinese of Re-examination decision dated Jun. 4, 2015 for Chinese Application No. 200780036383.6; 4 pages.
European Office Action dated Mar. 20, 2012 for European Application No. 07766370.6; 12 pages.
Response to European Office Action filed Sep. 28, 2012 for European Application No. 07766370.6; 10 pages.
European Office Action dated Oct. 15, 2013 for European Application No. 07766370.6; 5 pages.
Response to European Office Action filed Jul. 29, 2014 for European Application No. 07766370.6; 10 pages.
European Office Action dated Mar. 18, 2016 for European Application No. 07766370.6; 3 pages.
GB Search Report dated Jan. 5, 2007 for GB Application 0615110.4; 5 pages.
GB Office Action dated Jun. 1, 2010 for GB Application 0615110.4; 3 pages.
Response to GB Office Action filed Jul. 30, 2010 for GB Application No. 0615110.4; 9 pages.
GB Office Action dated Sep. 22, 2010 for GB Application 0615110.4; 4 pages.
GB Response to European Office Action filed Jan. 21, 2011 for GB Application No. 0615110.4; 13 pages.
GB Office Action dated Apr. 15, 2011 for GB Application 0615110.4; 3 pages.
Response to GB Office Action filed May 13, 2011 for GB Application No. 0615110.4; 12 pages.
Instruction letter from client dated Oct. 28, 2011 (including English claims) to file response to Examiner's Office Action; for Chinese Application No. 200780036383.6; 9 pages.

(56) References Cited

OTHER PUBLICATIONS

Email dated Nov. 2, 2011 from Foreign Associate with proposed amendment to claims 1 and 35; for Chinese Application No. 200780036383.6; 1 page.
Instruction letter from client dated May 16, 2012 (including English comments to claims) to file response to Examiner's Office Action; for Chinese Application No. 200780036383.6; 2 pages.
Instruction letter from client dated Feb. 26, 2013 to request re-examination and amend claims; for Chinese Application No. 200780036383.6; 1 page.
Instruction letter from client dated Jul. 4, 2014 to respond to the re-examination notice and amend claims; for Chinese Application No. 200780036383.6; 1 page.
Instruction letter from client dated Apr. 30, 2015 to respond to the re-examination notice and amend claims; for Chinese Application No. 200780036383.6; 3 pages.
English Translation of Chinese 2$^{nd}$ Re-examination Notification dated Mar. 27, 2014 for Chinese Application No. 200780036383.6; 6 pages.
Written Opinion dated Feb. 24, 2010 for PCT Application No. PCT/GB2008002802; 8 pages.
U.S. Appl. No. 12/673,939; 200 pages.
U.S. Appl. No. 12/673,939; 131 pages.
Final Office Action dated Sep. 27, 2016 for U.S. Appl. No. 12/673,939; 8 pages.
Notice of Allowance dated Mar. 17, 2017 for U.S. Appl. No. 12/673,939; 7 pages.

* cited by examiner

DEVICE, SYSTEM AND METHOD FOR PROCESSING A SAMPLE

CROSS REFERENCE TO RELATED APPLICATION

This application is a U.S. National Stage application under 35 U.S.C. §371 of and claims the benefit of International Patent Application PCT/GB2007/002854, filed Jul. 27, 2007, published in the English language as WO2008/012550, which application claims priority from GB application numbers GB0615110.4, filed Jul. 28, 2006 and GB0615109.6, filed Jul. 28, 2006.

The invention relates to devices, systems and methods for the processing of a sample. In particular the invention relates to in-the-field and on-site testing of nucleic acid in a biological sample.

BACKGROUND

The importance of nucleic acid testing (NAT) has become increasingly evident during the last decade for many purposes such as screening and diagnosis of infectious diseases and genetic disorders, testing for disease susceptibility, therapy monitoring, and improving the safety of blood supplies. NAT combines the advantages of direct and highly sequence-specific detection of the genome of an infectious agent with an analytic sensitivity that is several orders of magnitude greater than that of immuno-based tests, or virus isolation and cell culture methods. Due to the high sensitivity of NAT, its use in blood banks reduces the risk of infectious agent transmission during the period between infection and seroconversion, of infection with immunovariant viruses, of immunosilent or occult carriage. NAT-based assays consist of three basic steps: extraction of nucleic acid, genome amplification mediated by procedures such as (RT)-PCR; strand-displacement amplification (SDA) and transcription-based amplification system TAS (Guatelli et al., Proc. Natl. Acad. Sci. 87: 1874-1878 (1990); Compton, Nature 350: 91-92 (1991)), and amplicon detection.

Currently available NAT assays are complex and entail multi-step procedures that require highly trained personnel and specialised facilities. They require cold-chain transport and storage of reagents, a high investment cost for instruments, high running costs for reagents, and regular maintenance support. All of these restrict the use of NAT only to specialized well-equipped and technically advanced laboratories. Correspondingly, current NAT assays design is unsuitable for near-patient and field-testing e.g. physician's office, community-based clinics, emergency rooms, battlefield surgery units or point-of care health centres, district hospitals and inner-city clinics in the resource-limited settings of developing countries. These include predominantly countries of Africa, Asia, and Latin America with a high prevalence of infectious diseases.

An essential requirement for assays based on nucleic acid amplification is protection from amplicon contamination, currently solved by working in specialized laboratories using dedicated spaces for sample preparation, amplification and detection. This approach is not applicable for field-testing, near-patient testing and in resource-limited settings.

SUMMARY OF INVENTION

The invention provides devices, systems, a couplable reagent chamber and methods according to the appended independent claims, to which reference should now be made. Preferred or advantageous features of the invention in its various embodiments and aspects are defined in dependent sub-claims.

The invention may therefore advantageously provide an apparatus and method suitable for processing a sample, in particular suitable for amplifying nucleic acids from a sample in conditions where there is a lack of facilities and a limited supply of skilled personnel.

Accordingly, in a first aspect the invention provides a device or apparatus for the processing of a sample. The device comprises a processing chamber for receiving the sample and a plurality of reagent chambers suitable for containing processing reagents.

Preferably, the device also comprises an analyser chamber for containing an analyser or suitable analysis means, and a location apparatus or body for bringing the processing chamber sequentially into communication with the reagent chambers and with the analyser chamber to mix reagents with the sample and so implement a processing protocol or method.

Preferably, the device also comprises a sealing apparatus for sealing the processing chamber from the external environment. Such a sealing device may help prevent contamination of the sample during processing and may also, advantageously, prevent contamination of the point-of-use site, for example a clinic, with the processed sample.

The processing chamber, advantageously, has a processing-chamber opening for introduction of the sample and for communication with the reagent chambers as described below. In an alternative embodiment, the processing chamber may optionally have separate openings for these two functions.

In a preferred embodiment, the reagent chambers each have an associated reagent-chamber opening which is defined in the location apparatus of the device such that each reagent chamber can communicate with the processing chamber when its respective associated opening is disposed in overlapping relationship with the processing-chamber opening. The processing chamber is movable relative to the reagent-chamber openings such that a sequential communication is provided between the processing chamber and each reagent chamber in turn.

In different implementations the location apparatus may employ different geometries. For example the processing chamber may move in a circular path between its different positions, or stations, or it may move in a linear path or in any other suitable manner.

Advantageously, the device may be a non-reusable, one-shot disposable device. In this circumstance the device may be constructed from cheap materials and simply be thrown away after use. This may be an advantage when the device is used to conduct processing and analysis in regions of the world with limited resources, for instance if the device is used for medical testing in third world countries.

The device may be advantageously employed in the processing and analysis of biological samples, for instance blood samples or samples of genetic materials. Such biological testing is difficult to perform at present without using expensive equipment and experienced personnel.

It is preferred that, during processing of a sample, the contents of the processing chamber are sealed from the external environment, i.e. the device provides a closed system and the sample cannot escape from the device. The closed system helps eliminate contamination from external sources, and at the same time protects the external environment from contamination with the amplified product of the processed sample, which may produce false results. This is particularly important where processing of the sample involves the amplification of nucleic acid, as a small quantity of rogue nucleic acid could easily be amplified to provide a false result. As a result, it is also preferred that the sealing apparatus acts to seal the reagent chambers from the external environment.

The sealing apparatus may comprise any suitable means for sealing the processing chamber from the external environment while still allowing processing reagents contained in the various reagent chambers access to the processing chamber, for example when the processing chamber is moved to a predetermined position within the device in which it is in communication with a particular reagent chamber. In preferred embodiments of the invention the sealing apparatus may include elements from a body, frame, guide or supporting element of the device or a housing for the reagent chamber. Sealing in such cases may be simply achieved by the abutment of the processing chamber opening and a portion of the location apparatus or body, the seal optionally incorporating a seal element.

Although sealing of the contents of the processing chamber is important, the sealing apparatus need only act to seal the chamber during processing of the sample, when the sample is most likely to be affected by contamination. Preferably, however, the sealing apparatus also acts to seal the processing chamber from the external environment during any analysis step.

It is preferred that the device further comprises an access port which can open into or be aligned with the processing-chamber opening for providing initial access to the processing chamber. This is advantageous as the sample may then be introduced to the processing chamber without the need for removing the processing chamber from the device or opening the device. Such an arrangement further reduces the risks of contamination of the sample and corruption of the processing step on the sample.

Advantageously, any access port may be protected by a removable seal, for example a removable foil seal. This helps ensure that the device is free of contamination prior to introduction of the sample. The sample may be introduced to the processing chamber after removal of the seal and the processing chamber then moved such that the sealing apparatus seals the processing chamber from the environment.

Advantageously, the processing chamber may be movable between a plurality of discrete positions, or stations. In some of these positions the processing-chamber opening is advantageously disposed in overlapping relationship with a reagent-chamber opening. This allows communication between the chambers and thus the transfer of reagent from the reagent chamber to the processing chamber.

It may be desirable that there are positions for the processing chamber in which the processing chamber opening is not in overlapping relationship with any of the reagent chamber openings. Such positions may be advantageously used for incubation or mixing stages during processing, if required for a processing protocol for which the device is designed.

Reagent chamber openings may be defined in or through the device body or location apparatus and it may be advantageous for the reagent chambers themselves to be formed integrally with any such body or location apparatus. Reagents may be pre-loaded into the reagent chambers in such a construction, in a clean facility for example, thereby minimising opportunity for contamination prior to use. Each such chamber could be formed by a blister or bubble extending from the body or may be a more complex structure such as a tube rising up from the body. An integral chamber may be particularly advantageous for use with dried reagents, for example freeze-dried or lyophilised reagents.

It may be preferred that at least one of the reagent chambers is couplable to the body or location apparatus at its associated reagent-chamber opening. Such a construction for the device may be advantageous where liquid reagents are used as it may be more difficult to load liquid reagents into integral chambers and to store liquid reagents in integral chambers before use of the device. Couplable or removable chambers may also be particularly advantageous where the device is designed to be used for a wide range of different tests, each of which requires different reagents. In such a situation the specifically required reagents could be added to the device by coupling the appropriate reagent chamber(s) to the body.

It is preferred that any couplable chambers form a seal when coupled to the device. Coupling may be achieved by any suitable means, for example by use of a screw or bayonet fitting aligning the reagent chamber with its associated opening, or may be a press fit.

It may be particularly advantageous for the device to comprise both one or more integral chambers for containing dried reagents and one or more couplable chambers for containing liquid reagents, if the device is designed for is a test protocol involving both solid and liquid reagents.

Preferably, during use of the device the reagents or any analyser are introduced into the processing chamber under the influence of gravity. This minimises the mechanical elements required in the device and simplifies its use. An example of this would be where a reagent is maintained within its chamber by a barrier and the barrier is temporarily removed as the processing chamber passes beneath the opening leading from the reagent chamber. Gravity could then act on the reagent, if the device is held in an appropriate orientation, to urge it into the processing chamber. Alternatively, in the case of liquid reagents, the reagent chamber may be provided with a bung or valve, which when removed or opened allows the reagent to flow into the processing chamber. If gravity is the means by which a reagents is introduced to the processing chamber it is important that the device is used in the correct orientation.

Optionally, at least one dispenser, such as a plunger, may be used in the device to facilitate introduction of a reagent from its reagent chamber into the processing chamber. The use of plungers may be particularly applicable to the introduction of liquid reagents.

Although it may be possible to load reagents into the appropriate reagent chambers at the point of use, it is preferred that the device is loaded or charged with the correct reagents prior to arriving at the point of use. This helps prevent contamination, which may provide false results in any analysis, and it also removes the need for a skilled technician to handle and measure out correct quantities of reagents at the point of use.

The analyser or analysis means, when present, may itself be contained in a chamber with an associated opening. Such a chamber may be termed an analyser chamber, and may function on the same principle as the reagent chambers described above. Where contact is required between the analyser and the processed sample it may not matter whether the analyser passes into the processing chamber, or whether the contents of the processing chamber pass into the analyser chamber.

It is particularly advantageous for the analyser to be a test strip or dipstick providing a visual result. The test strip may be dropped into the processing chamber to contact the processed biological sample. The processed sample may then be wicked up the test strip to provide the required analysis.

A test strip commonly has a greater length dimension than thickness and width, and thus may be housed in a similarly-dimensioned analyser chamber. In such a case it may be preferred that the test strip is positioned in a chamber lying horizontally on the surface of the device in use, for example in order to make the device more compact, in which case the entire device may need to be rotated to allow communication between the test strip and the processed sample. Advantageously, where the analyser gives a visual result the wall of the analysis chamber may be substantially transparent so that the result of the analysis can be seen without any need to open the device.

Alternatively, the analyser may comprise a reflectometer or a densitometer.

The device may comprise a ratchet apparatus or indexing means to aid the location of the processing chamber. Such an apparatus or means may enable the processing chamber to be moved to discrete, fixed, positions within the device and may also advantageously prevent the processing chamber from moving in a reverse direction through the device.

In a further aspect the invention may provide a system for the processing of a biological sample comprising a device as previously described or as defined in any claim and an external heat source or heating means adapted to engage with the device. Many biological processing steps require carefully controlled thermal conditions and thus a heat source adapted to engage with the apparatus may be desirable for the accurate use of the device. Preferably the heat source is adapted to engage with the processing chamber of the device, thus it may be advantageous for the outer portion of the processing chamber to project from the device so as to be accessible.

To facilitate mixing, the system may further comprise a vibrator or vibration means for vibrating the device, or the external heat source may incorporate a vibrator. Preferably the external heat source is a simple heating block shaped to receive the device, or at least to receive the processing chamber.

The system may additionally comprise one or more couplable reagent chambers. Any such chambers may be pre-loaded with reagent and can advantageously be stored separately from the device, for example in a refrigerator if necessary.

In a further aspect the invention provides a method of processing a sample in a device having a processing chamber, a location apparatus and a plurality of reagent chambers. The method comprises the steps of loading the sample into the processing chamber and operating the location apparatus first to seal the processing chamber from the external environment, and then to move the processing chamber relative to the plurality of reagent chambers so as to introduce, in sequence, a corresponding plurality of reagents into the processing chamber from the reagent chambers.

Each reagent may be added or introduced to the processing chamber by the action of gravity, or a dispenser such a plunger may be used.

The resulting processed sample may be analysed using an analyser. Any such analyser may be advantageously contained in an analyser chamber of the device.

Advantageously, the above-described method can be applied to a device with any number of reagent chambers, the steps of moving the processing chamber and adding reagents being modified for any number of reagent chambers and associated reagents.

Advantageously, the processing chamber moves sequentially past each of a number of reagent chambers in turn. The number and contents of the reagent chambers can be tailored to any processing required for analysis of the sample. In the field, the end user need only follow a simple set of instructions and need not be concerned with the details of the science involved at each step. Thus the processing of the sample need not be carried out by a skilled user.

Optionally, additional steps may be added both prior to and subsequent to each addition of reagent to the processing chamber. Such steps may include mixing and incubation steps and such additional steps would depend on the type of processing desired for the sample.

Where the processing protocol uses a liquid reagent it may be advantageous to supply the device to the end user in two parts. One part of the device may comprise the processing chamber and reagent chambers loaded with lyophilised dry reagents and an analysis means, for example a test strip. This first part of the device may be hermetically sealed with desiccant. The second part may be a couplable reagent chamber, for example as described above, containing a liquid reagent. The two parts of the device would then be clipped together before use.

In broad terms, the invention may be a device for the processing and analysis of a biological sample the device comprising at least one processing chamber which, in use, is sealed from the external environment. Thus, processing of a biological sample may be carried out with low risk of contamination from the environment or to the environment. Preferably the device is adapted to use both solid and liquid processing reagents. Particularly preferably, lyophilised reagents are preloaded into the device prior to its despatch to a user. Thus, lyophilised reagents may be loaded into the device by skilled operatives in a clean facility and the device despatched to an in the field user who may not have access to such a clean facility.

In one embodiment the invention may provide a device for the processing and analysis of a sample comprising a plurality of processing chambers coupled in series by conduits, for example by capillary tubing. Such a device would include a port coupled, via a conduit, to a first chamber of the series for the introduction of a sample and an analysis chamber coupled, via a conduit, to a last processing chamber of the series. The device may comprise means for creating pressure differentials in the conduits such that the sample may be moved from chamber to chamber.

Pressure differentials may be caused by a partial vacuum applied to the conduits. A convenient means for creating a pressure differential may be the use of plunger actuators. Such plunger actuators could be actuated by a human user in the field or, alternatively, may be actuated by a suitable machine.

The invention may, thus, comprise a system including a device having a plurality of processing chambers coupled in series by conduits, as described above, and a machine into which the device fits that is suitable for automatically operating the device.

A method of processing a sample within a device according to a fourth embodiment of the invention comprises the steps of introducing the sample into a first processing chamber of the series, performing a first processing step, moving the sample to a second chamber of the series, performing a second processing step in which movement of the sample within the device is effected by pressure differentials.

Advantageously, a sample may be mixed during processing by turbulence caused by repeatedly moving it backwards and forwards through conduits between adjacent chambers. Such mixing may be useful where a particular processing protocol requires agitation of a sample.

It may be advantageous for the device to be disposed of after completing analysis on the processed sample.

Where the processing protocol involves amplification and detection of nucleic acid it may be advantageous to perform a treatment to neutralise previous processing reactions or to deactivate amplified product for priming of new amplification reactions. It may, thus, be advantageous to treat the device (for example a device according to any embodiment or aspect described herein) and the used sample post-analysis to help prevent contamination of the point-of-use site. For example, to help prevent amplicon carryover contamination, the amplicon left in the device after a detection step could be treated with nucleic acid modifying or hydrolysing agents that prevent priming of further amplification reactions. Decontamination may be particularly desirable where batches of samples are to be tested on the same site.

One such decontamination treatment described in U.S. Pat. No. 5,035,996 (Hartley, Life Technologies, Inc) involves incorporation into the amplified product of a ribo- or deoxy-nucleoside triphosphate (rNTP or dNTP) base that is not generally found in the sample to be analyzed: for example dUTP in the case of DNA analysis. The amplified product will thus have a sequence that has Uracil in multiple positions. The enzyme uracil DNA glycosylase (UDG) is added to the sample prior to amplification. This will cause enzyme hydrolysis of any contaminating reaction product (containing Uracil) without affecting the natural DNA in the sample.

Preferably decontamination is a chemical treatment or reagent that not only modifies, but also degrades nucleic acid e.g. non-enzymatic degradation of nucleic acid with chemical nucleases. Examples of chemical nucleases are known in the art e.g. divalent metal chelate complexes, such as copper Phenantroline-Cu (II) or Ascorbate-Cu (II) cleavage as described by Sigman D. S. et al (J. Biol. Chem (1979) 254, 12269-12272) and Chiou S. (J. Biochem (1984) 96, 1307-1310).

A decontamination reagent could be conveniently delivered into the processing chamber of the device, after analysis of the sample, using a couplable reagent chamber, as described above. The device may, therefore, be preloaded with both processing reagents and a post-analysis treatment, or decontamination, reagent. Alternative methods for delivery of decontamination reagents include delivery by luer lock syringe or through a septum.

SPECIFIC EMBODIMENTS

Figure 1B:
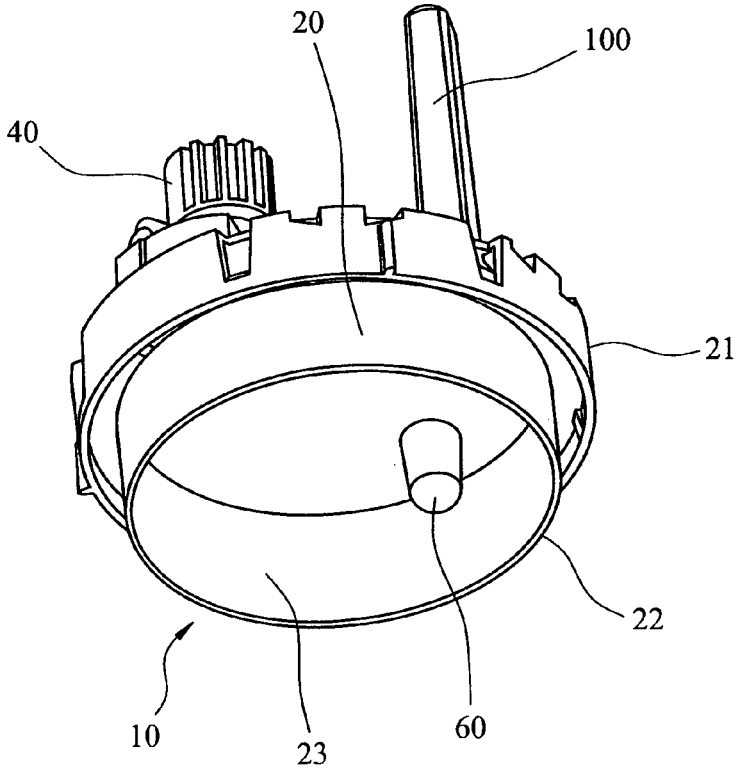
Figure 1C:
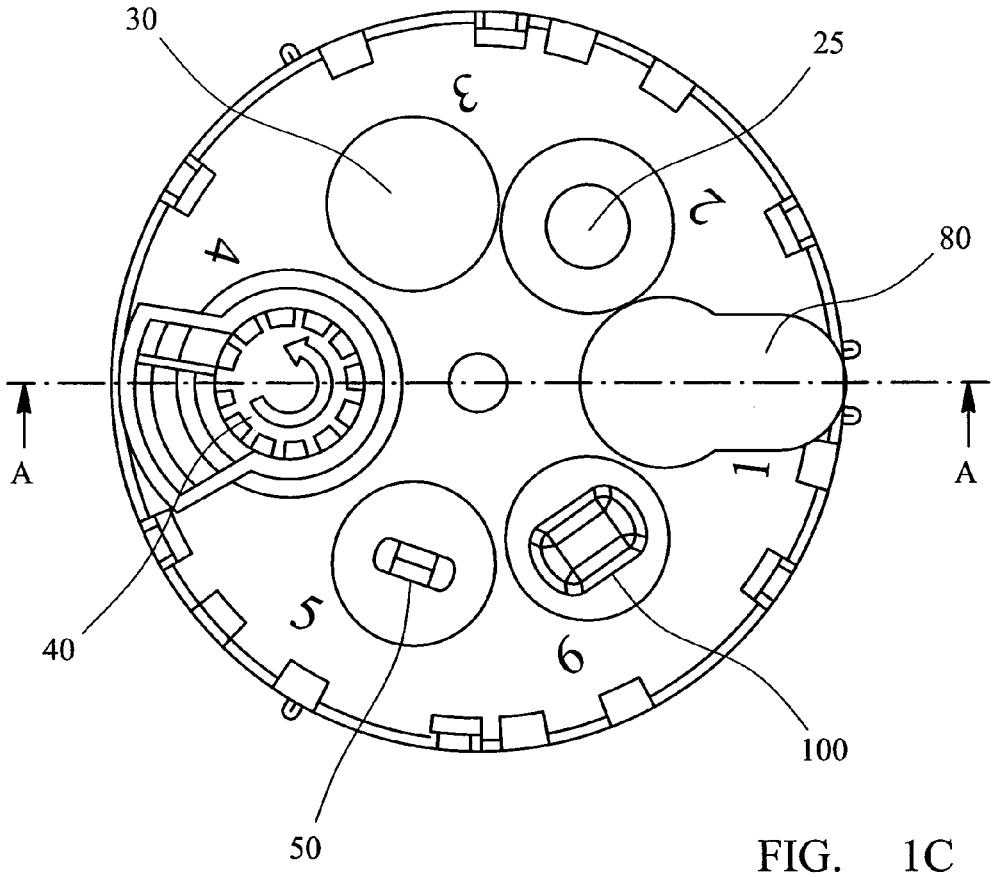
Figure 1D:
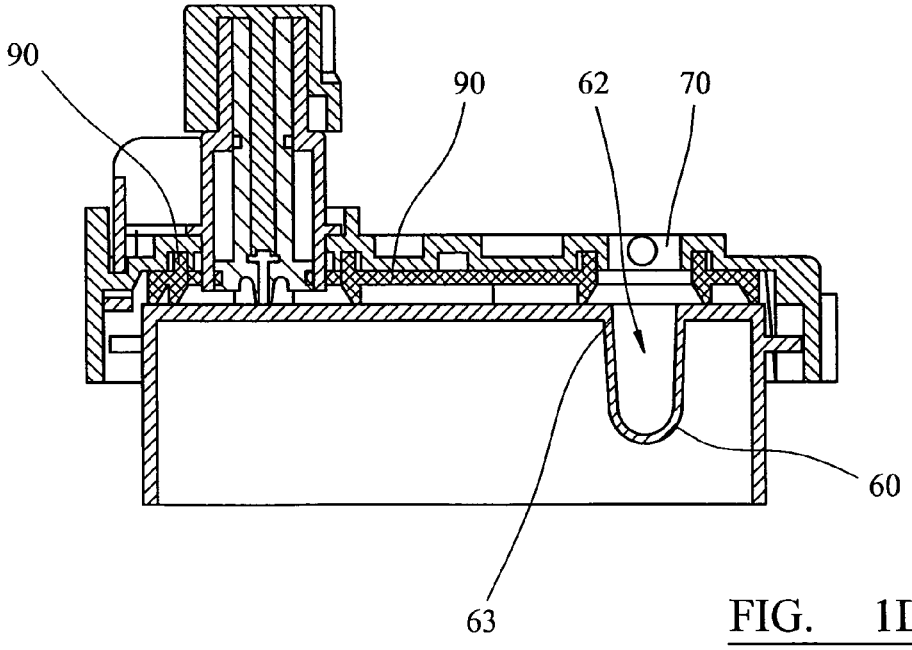
Figure 1E:
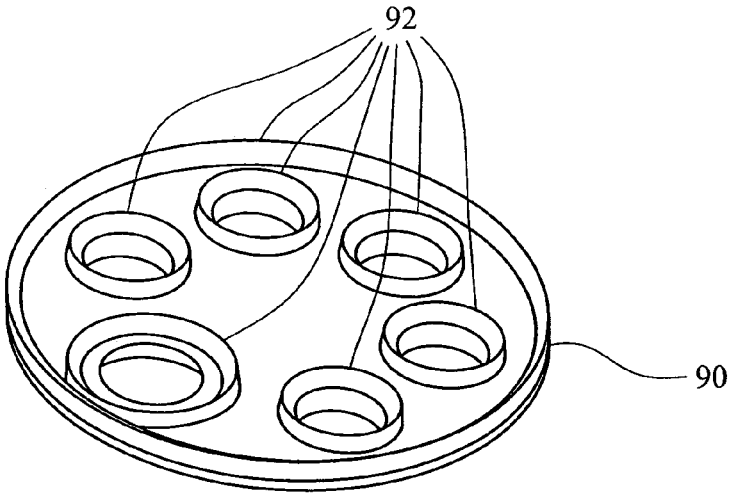
Figure 1F:
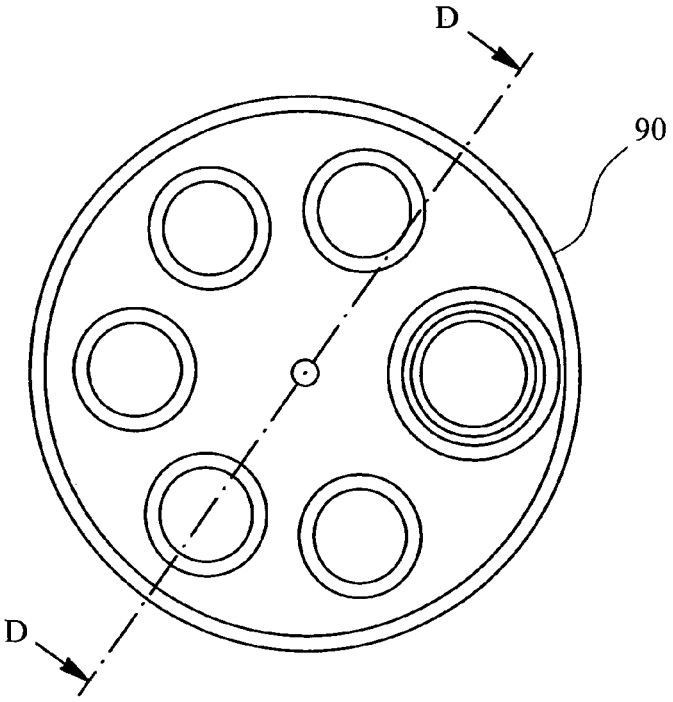
Figure 1G:
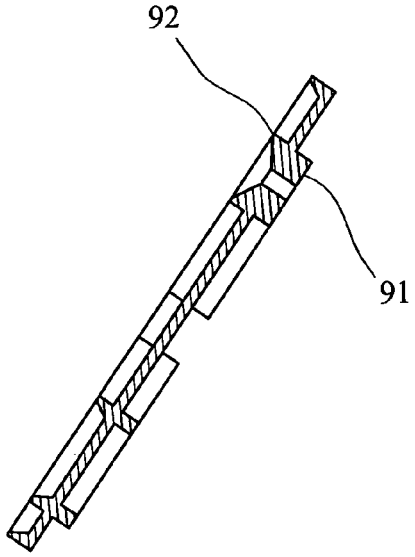
Figure 2:
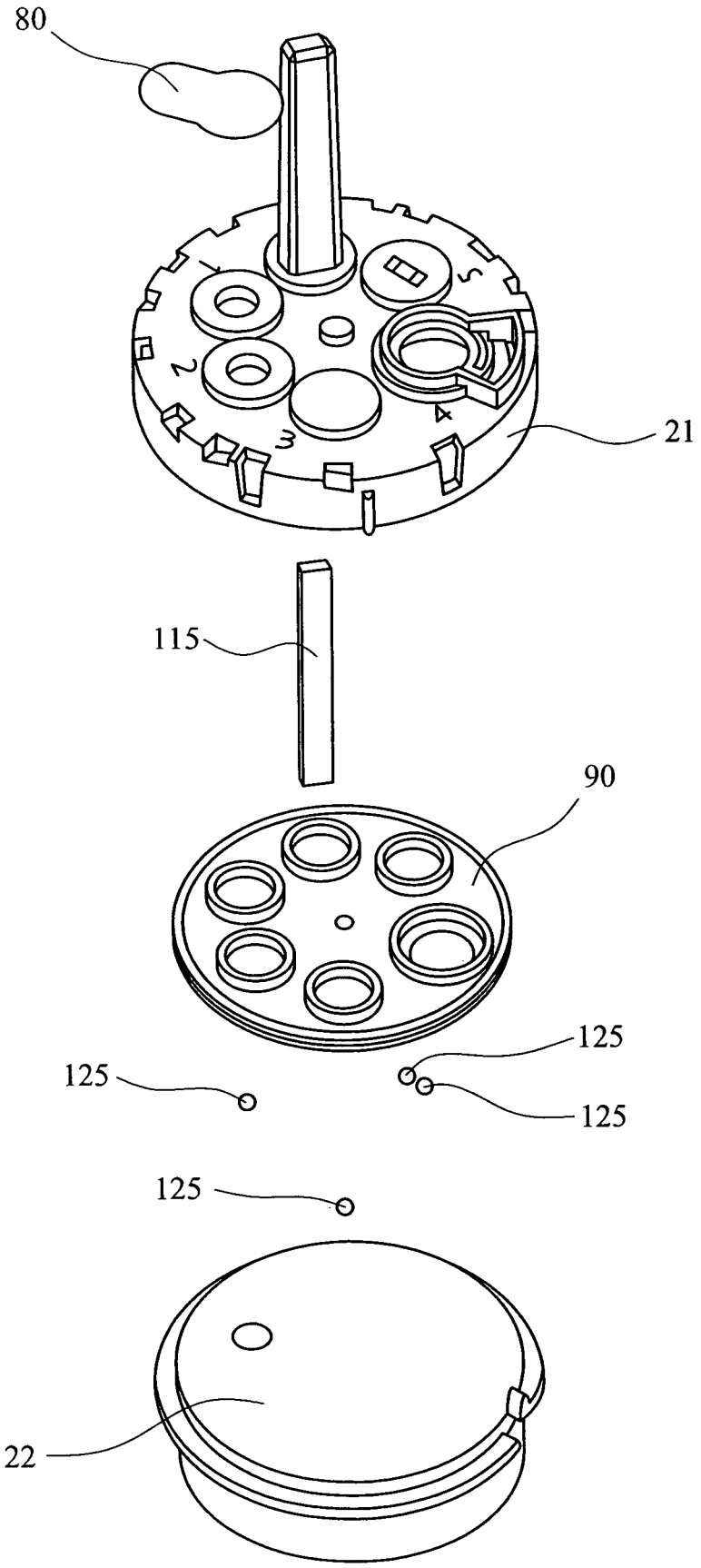
Figure 3:
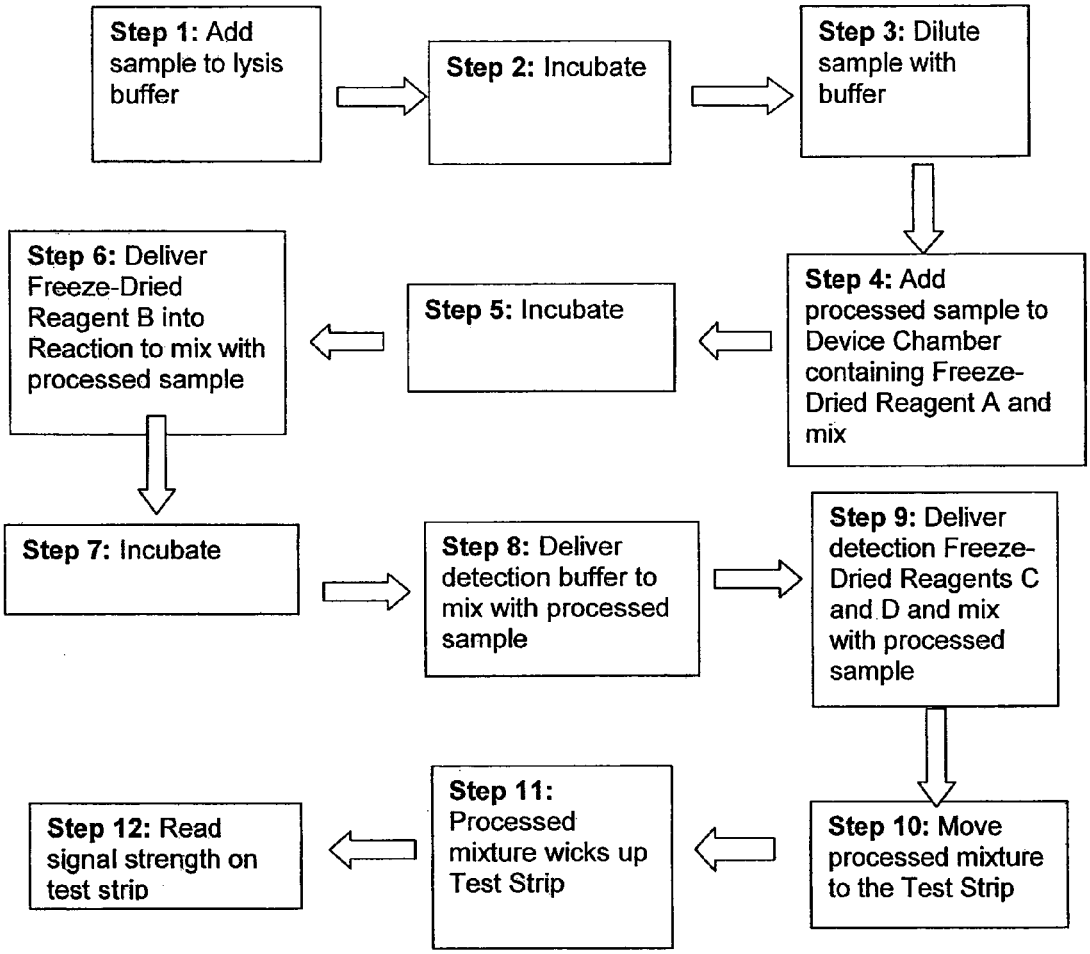
Figure 4A:
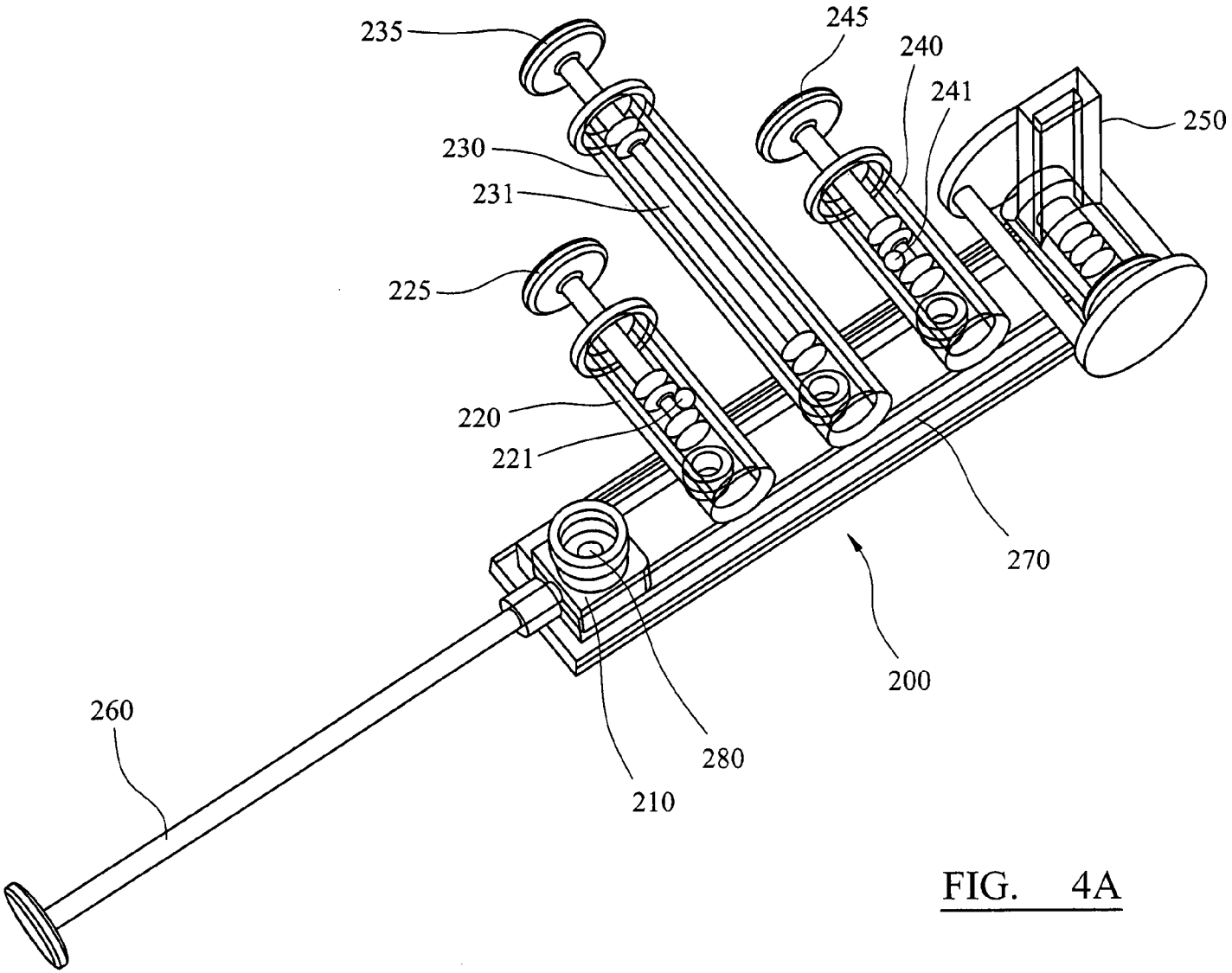
Figure 4B:
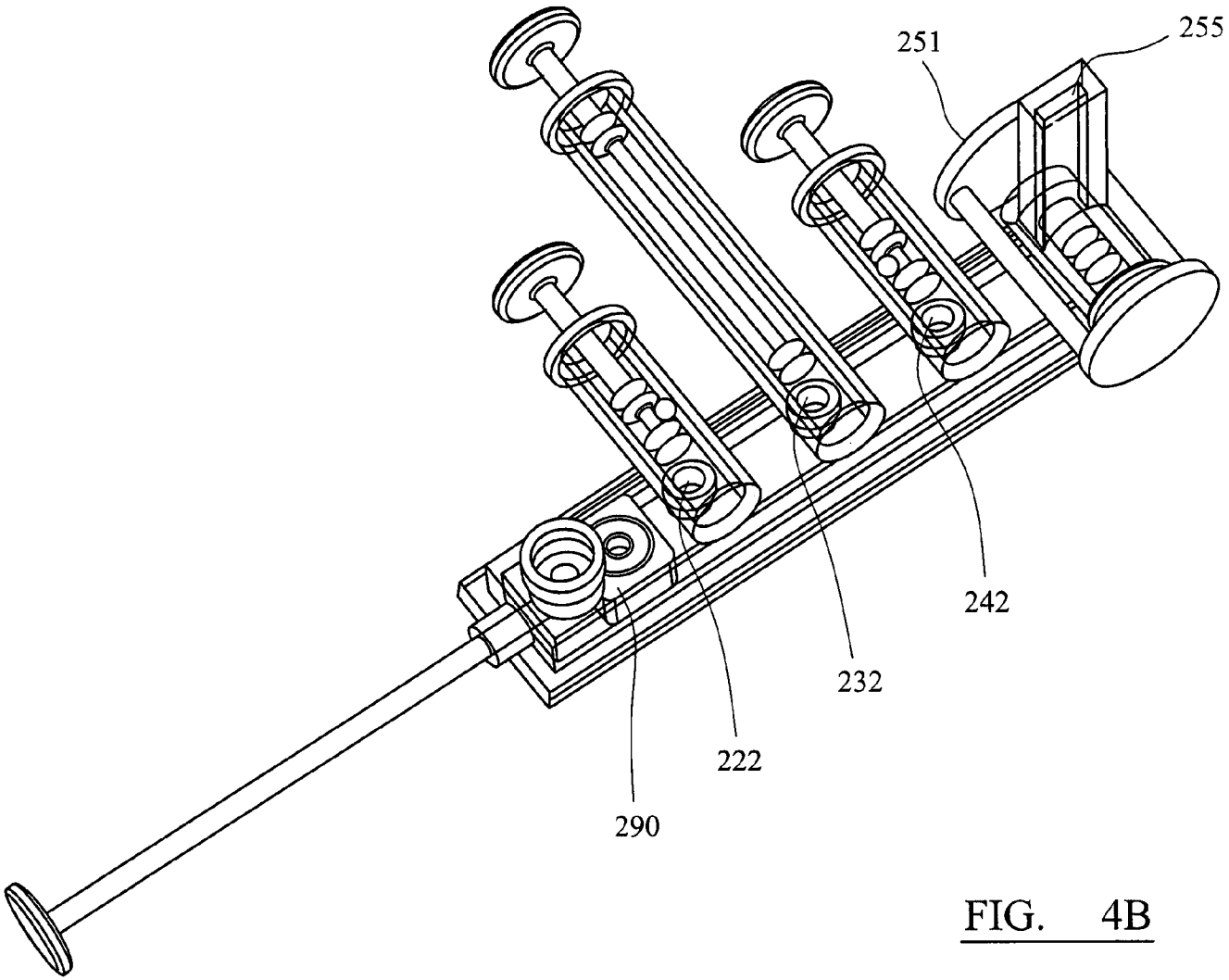
Figure 4C:
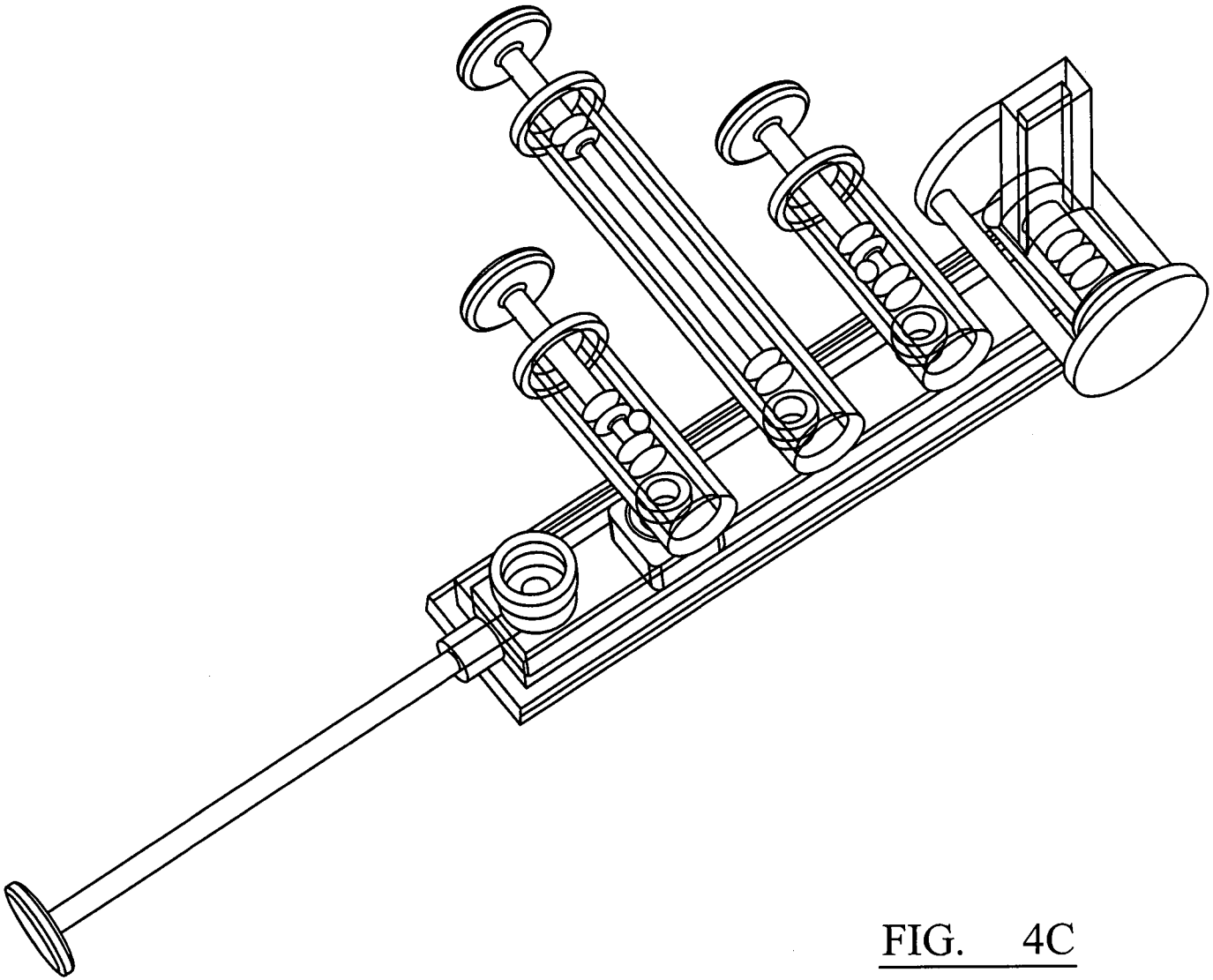
Figure 4D:
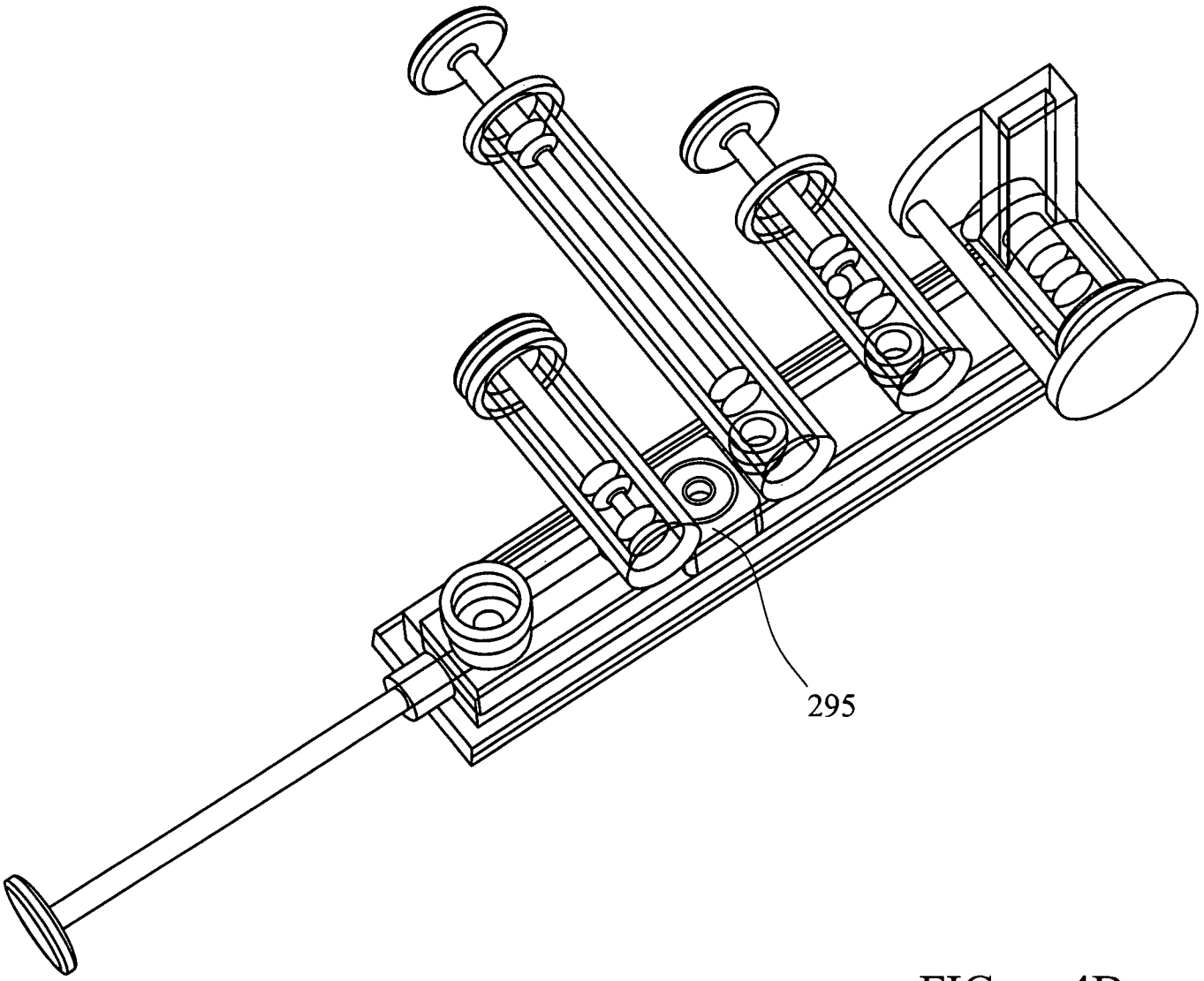
Figure 4E:
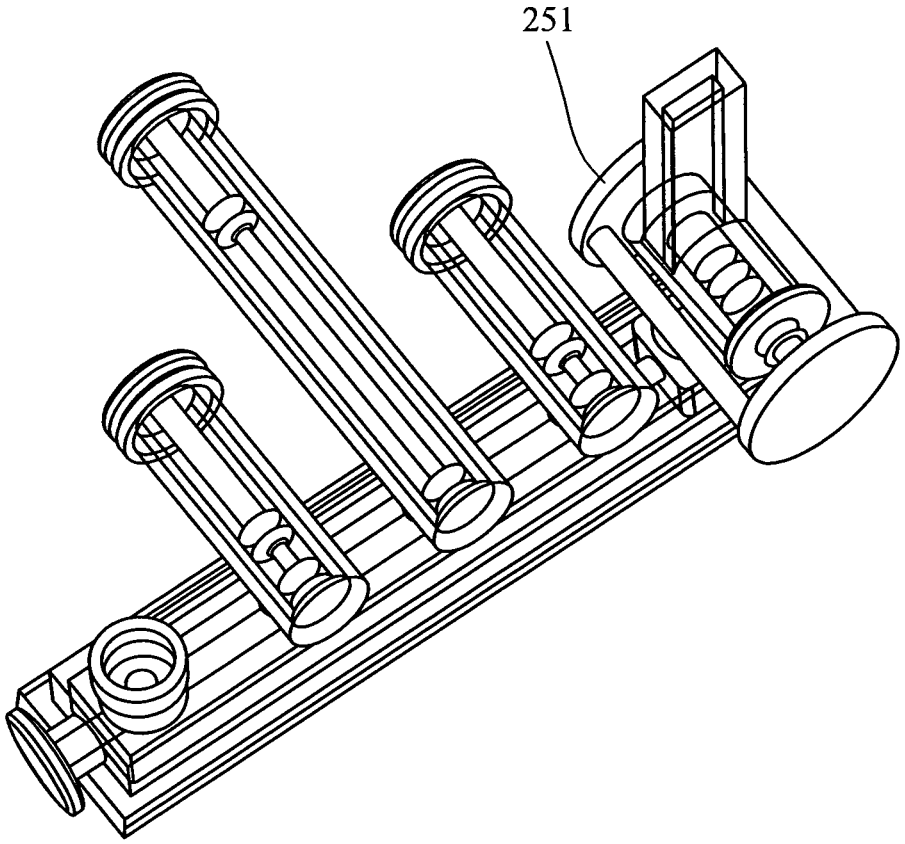
Figure 5A:
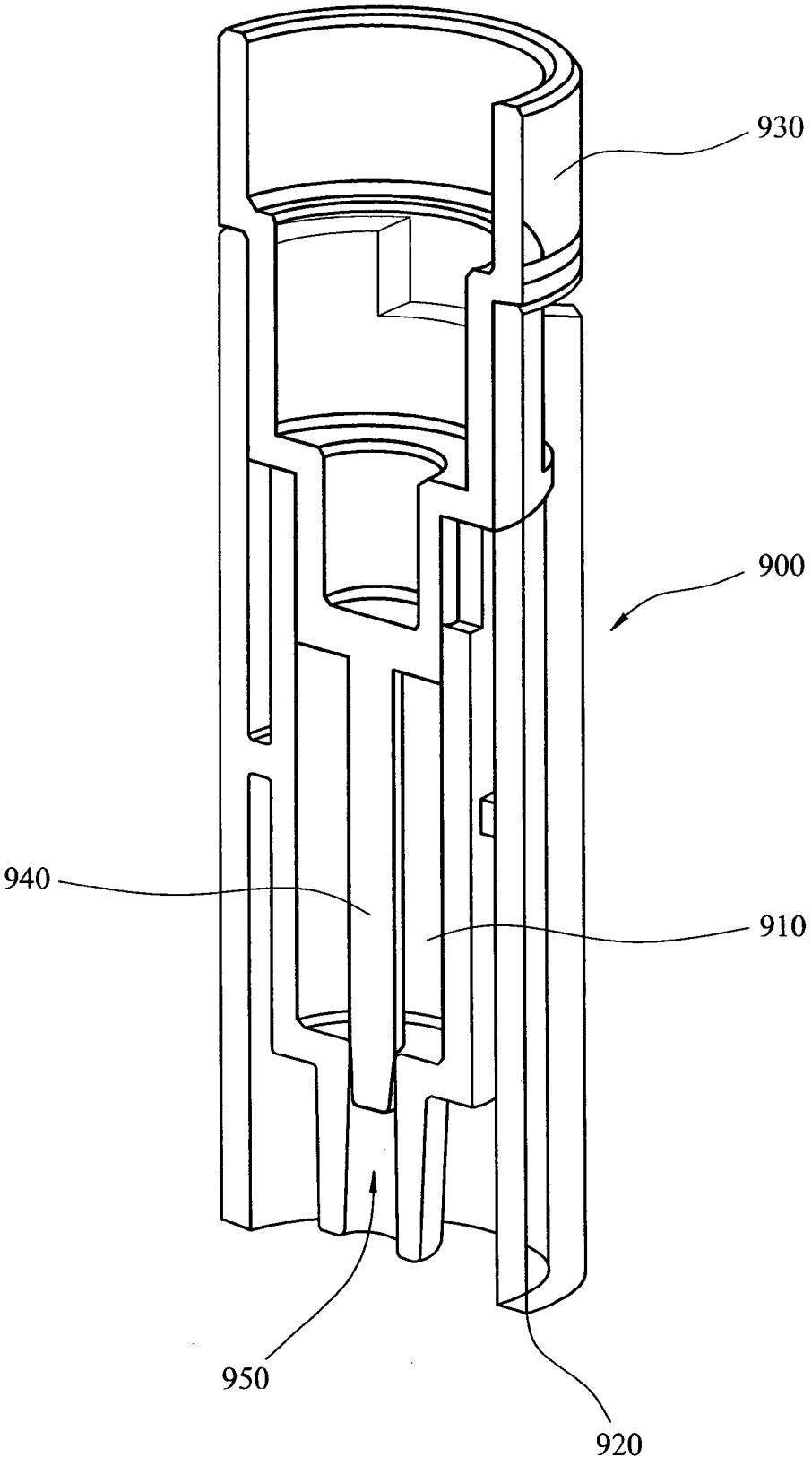
Figure 5B:
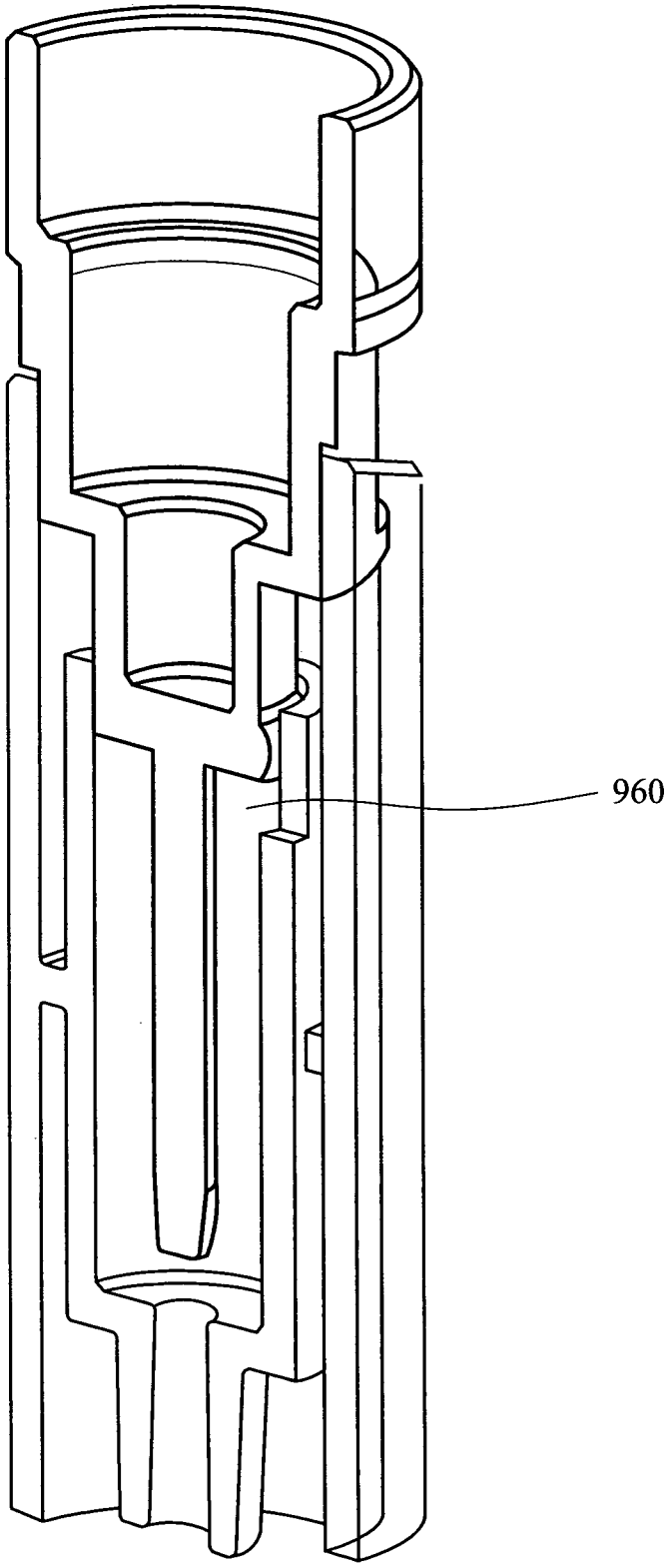
Figure 6A:
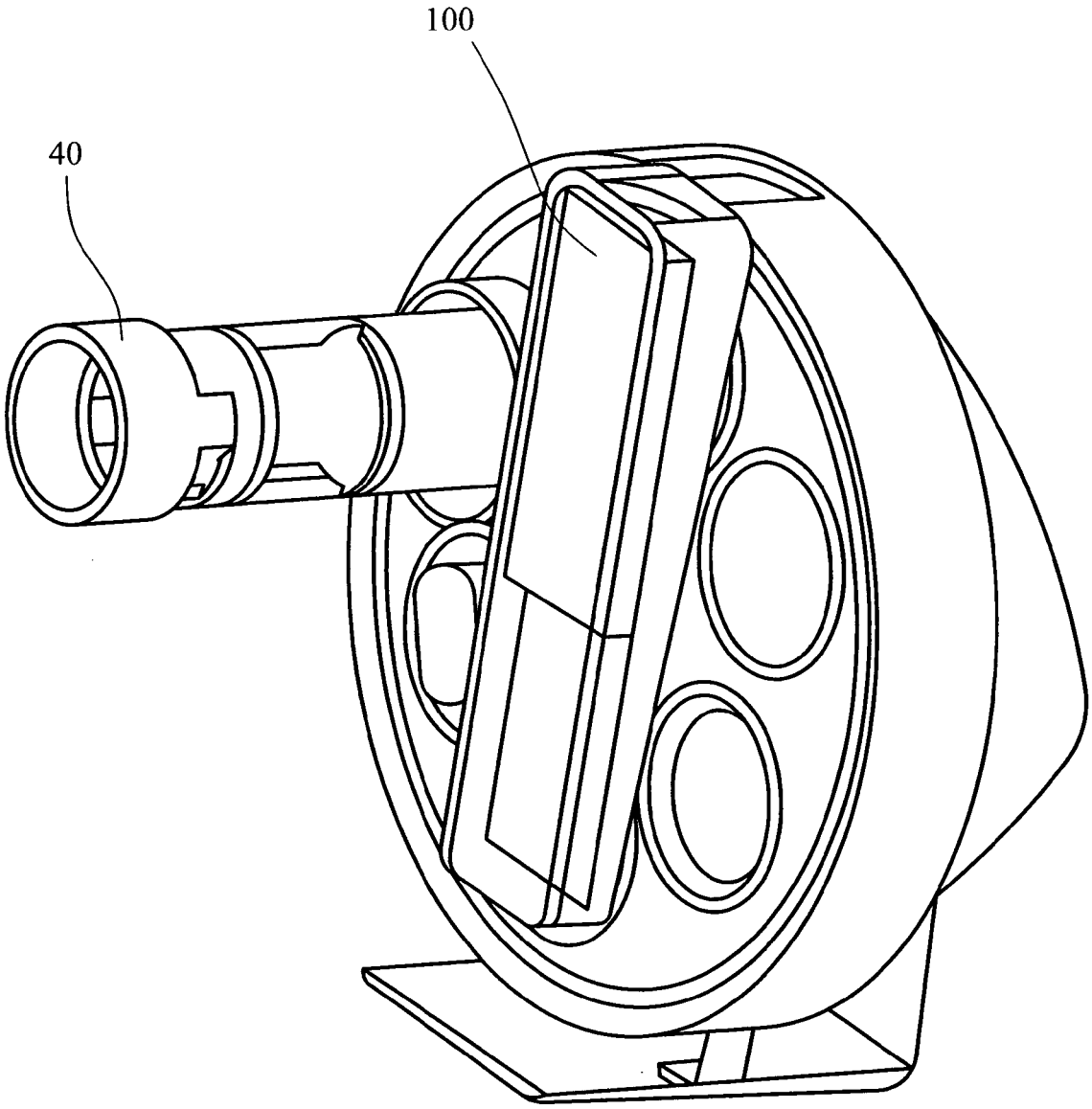
Figure 6B:
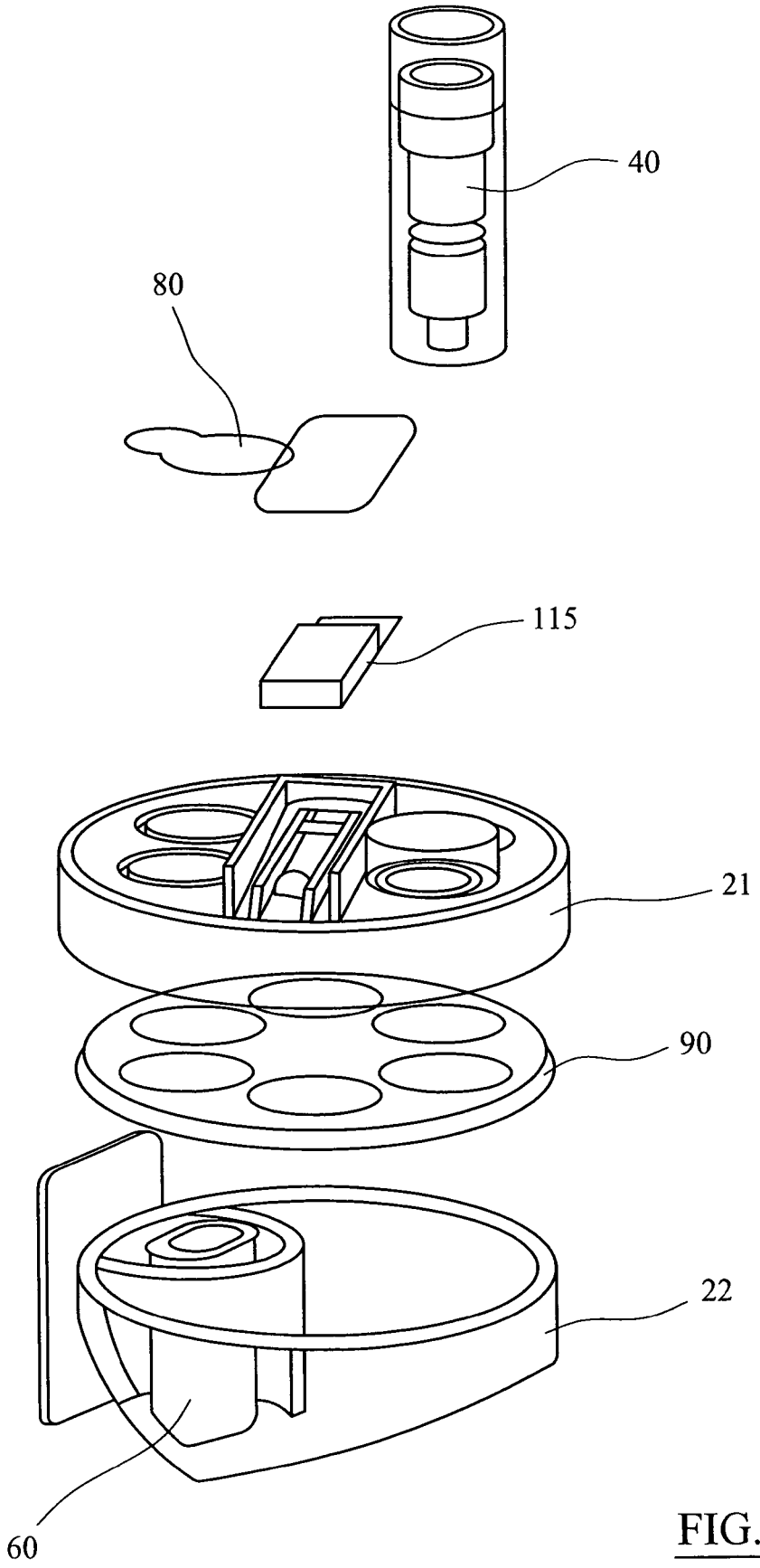
Figure 7:
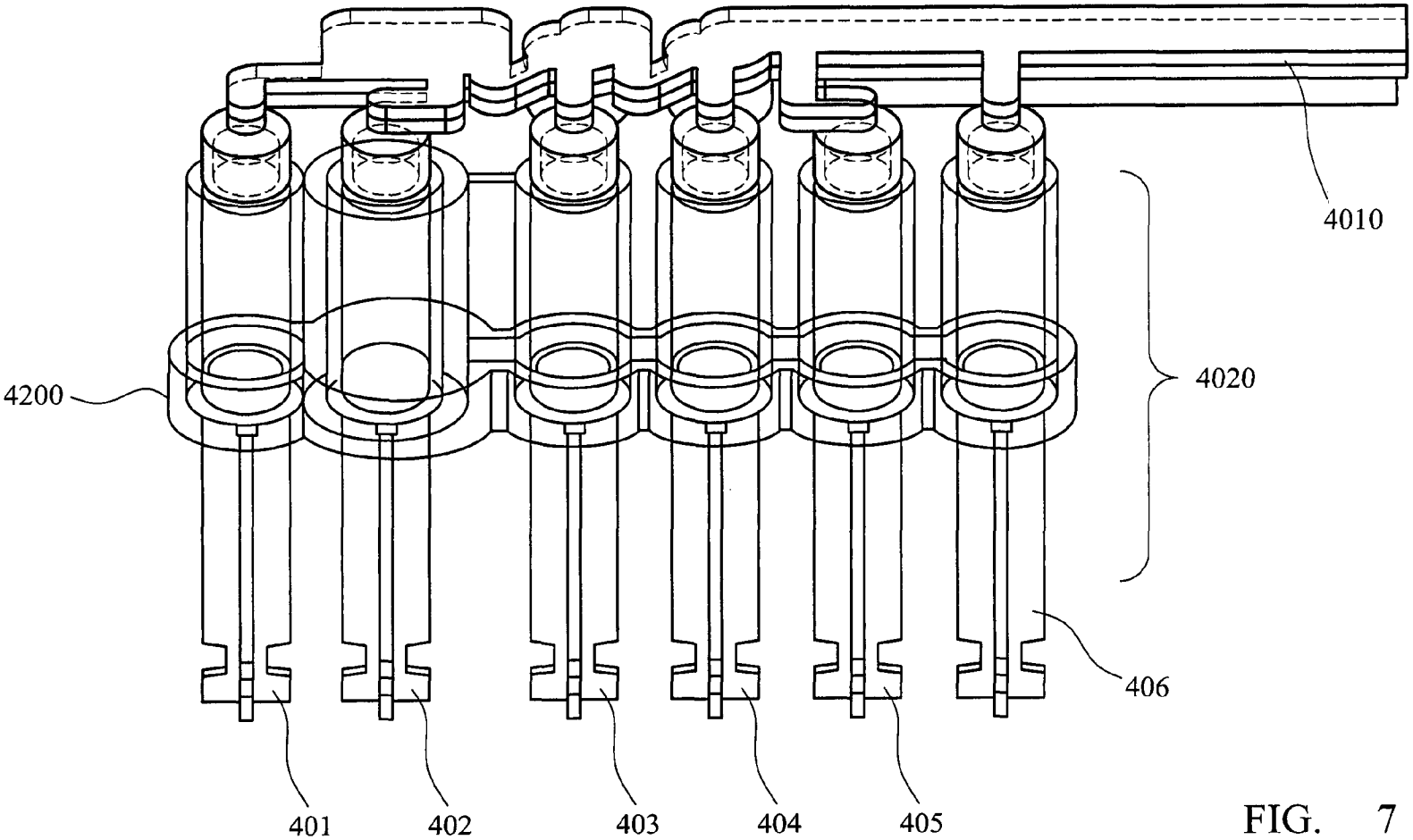
Figure 8:
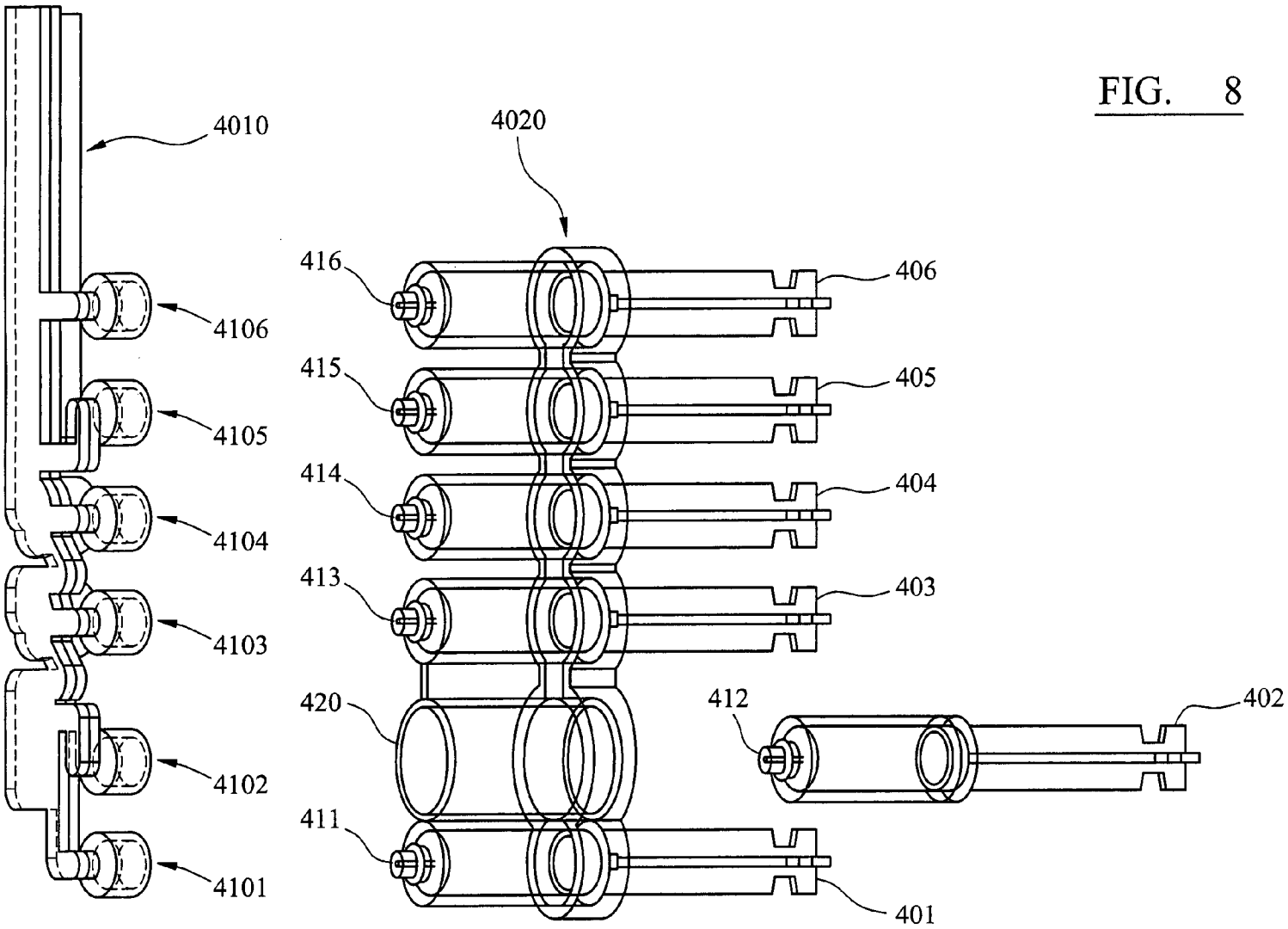
Figure 9:
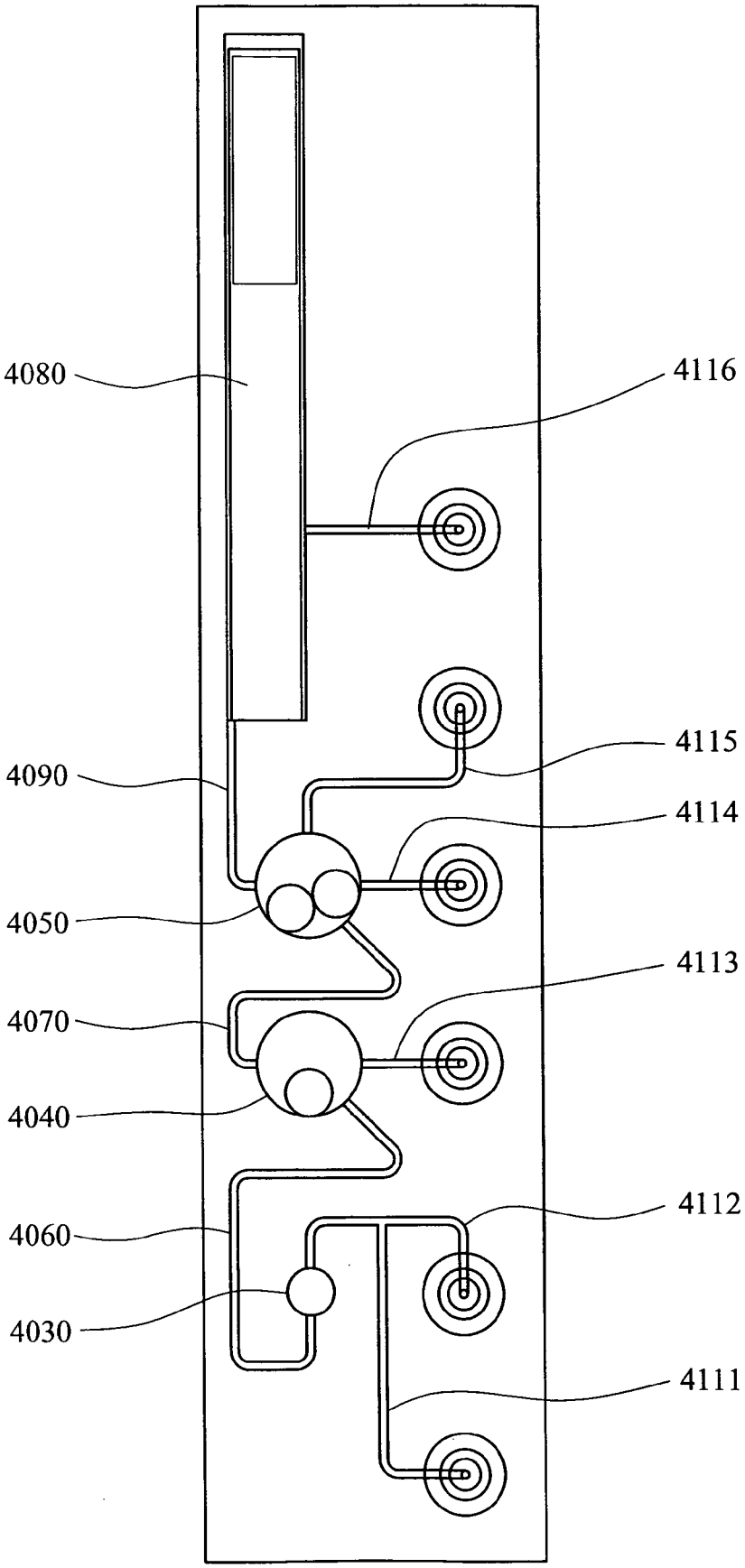
Figure 10:
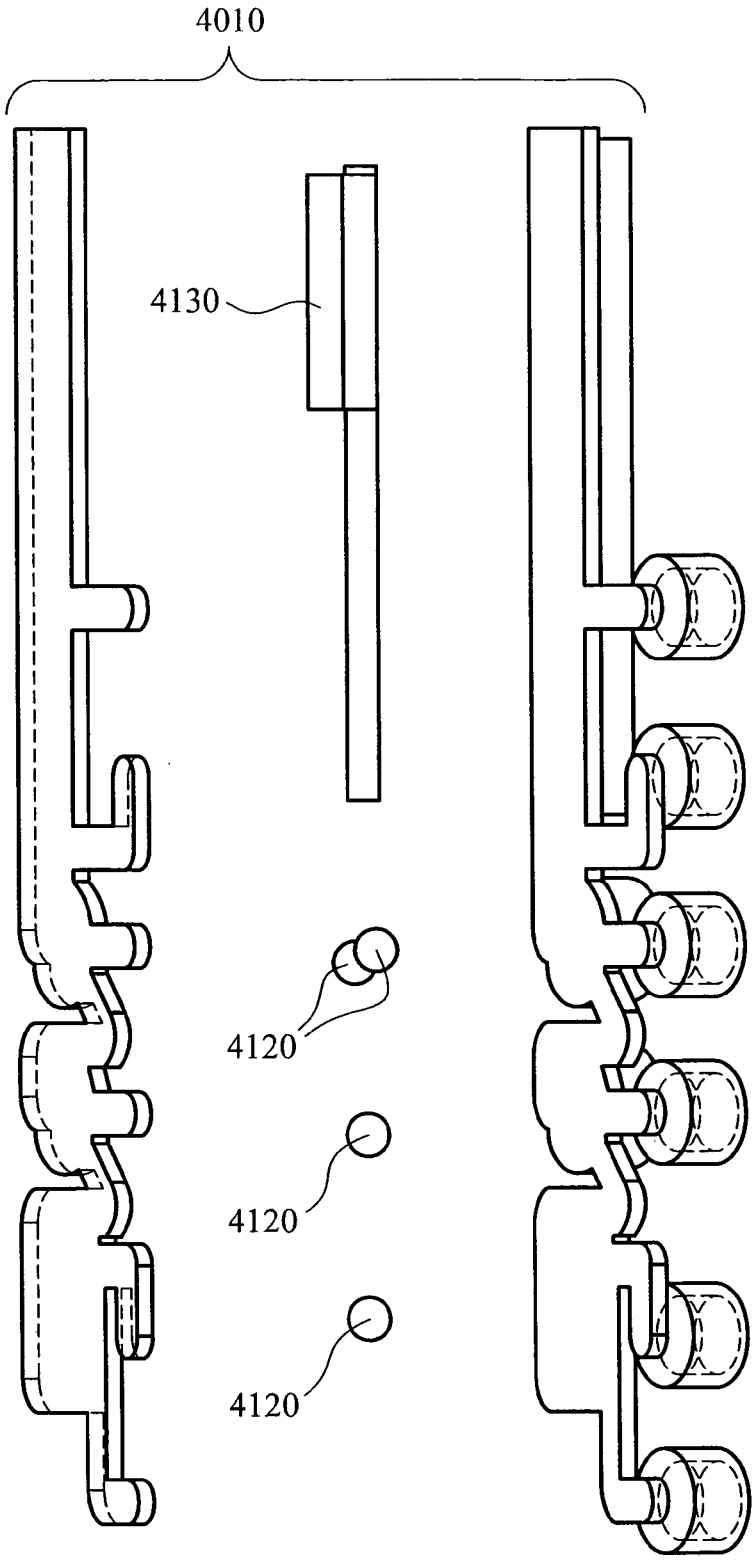
Figure 11:
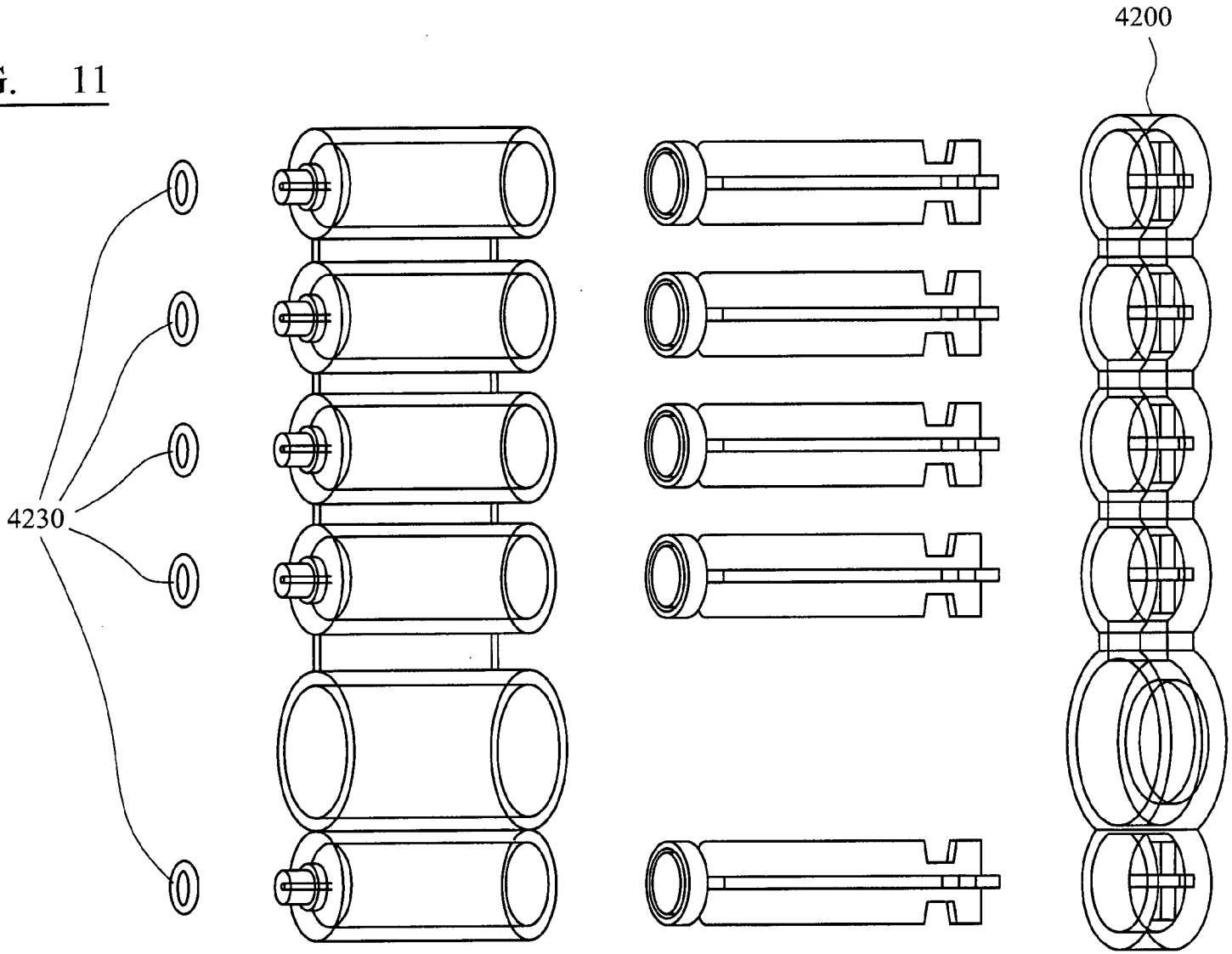
Figure 12:
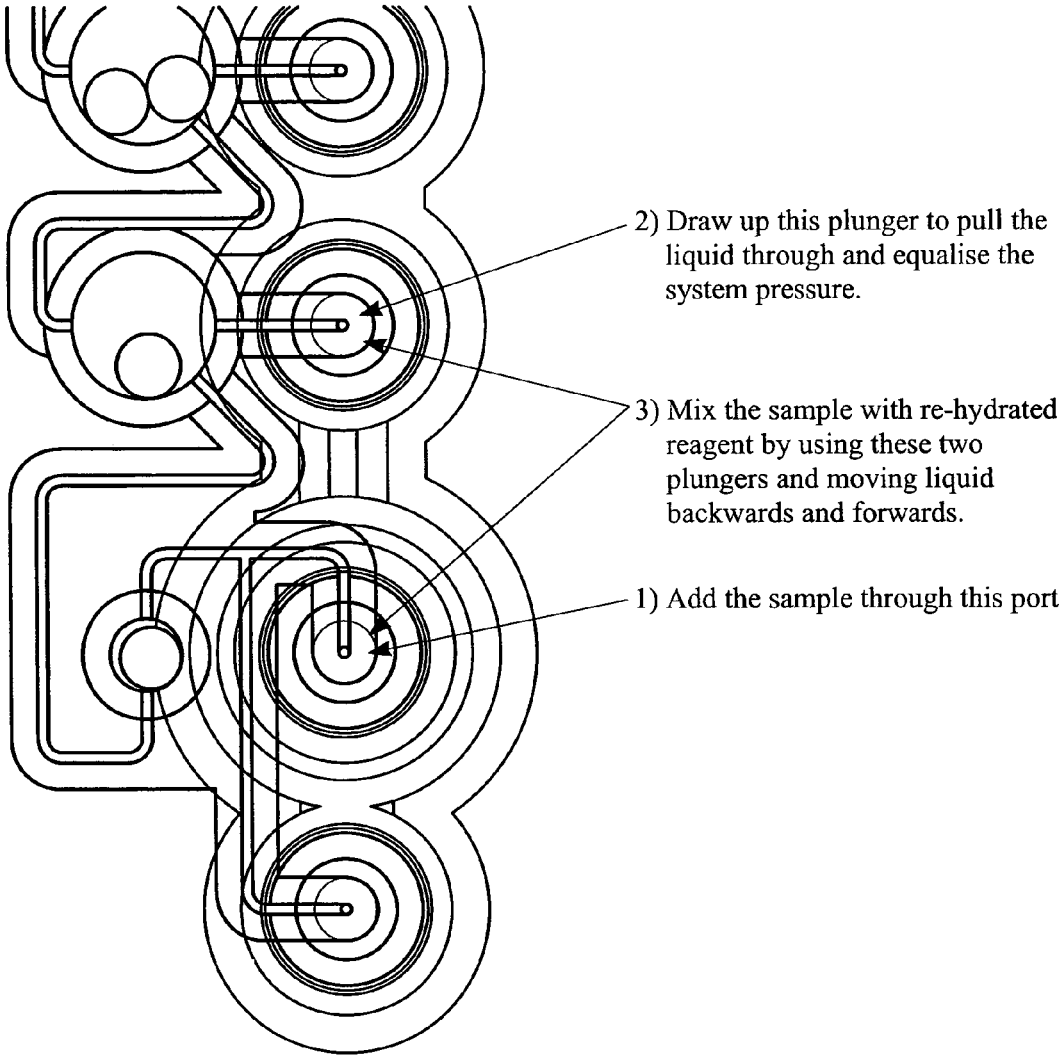
Figure 13:
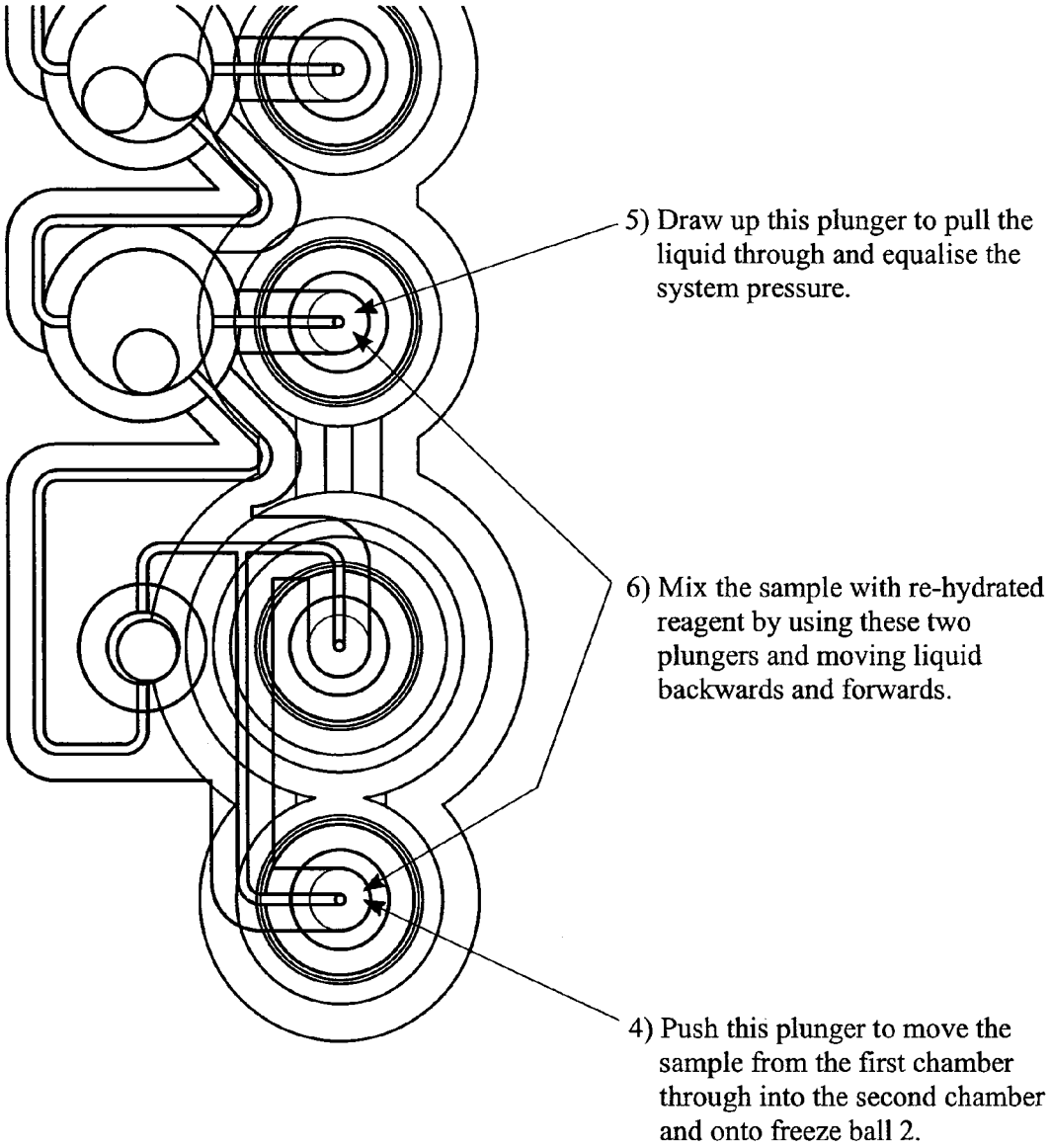
Figure 14:
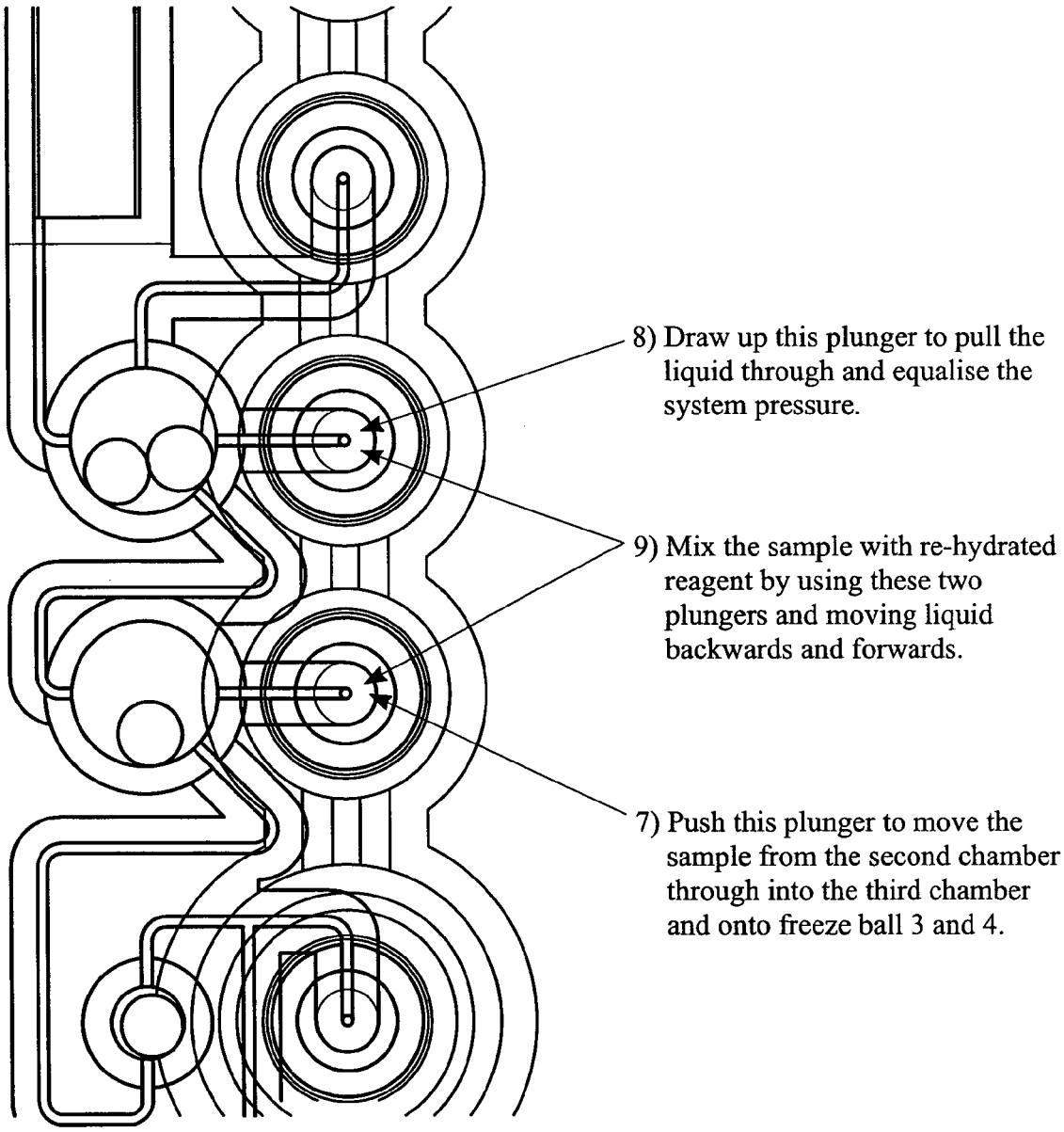
Figure 15:
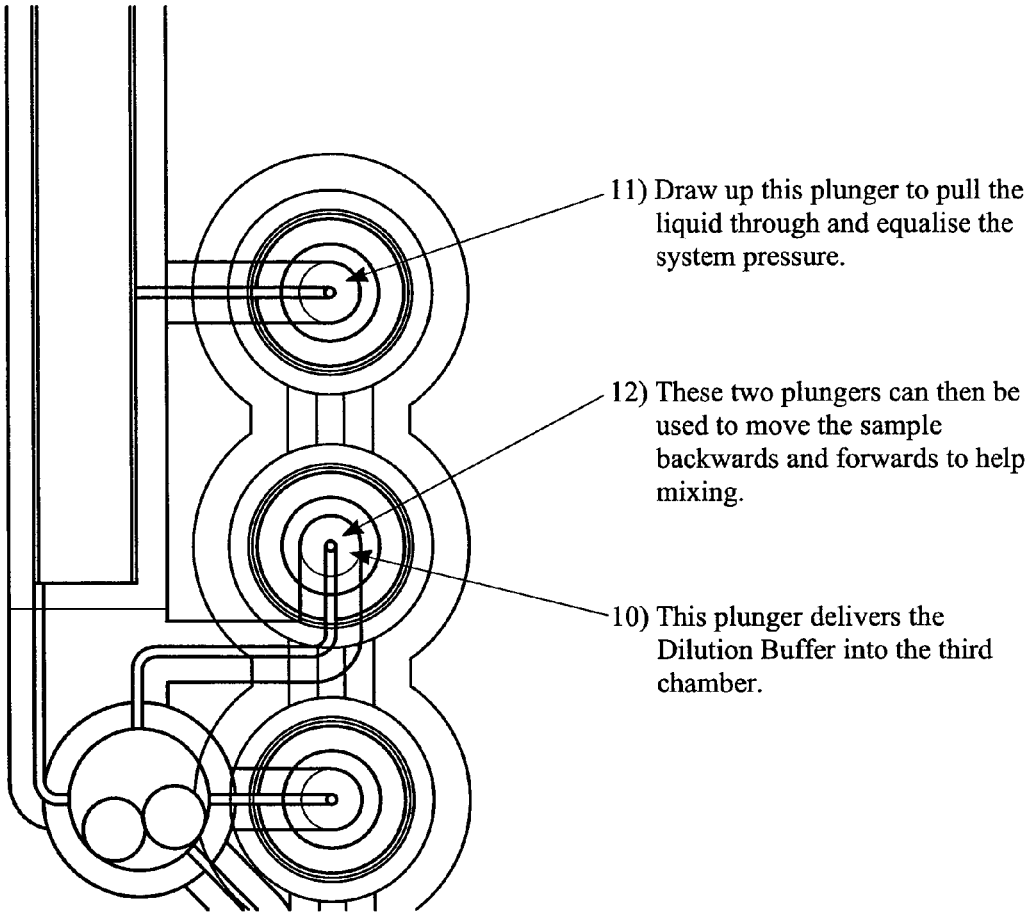
Figure 16:
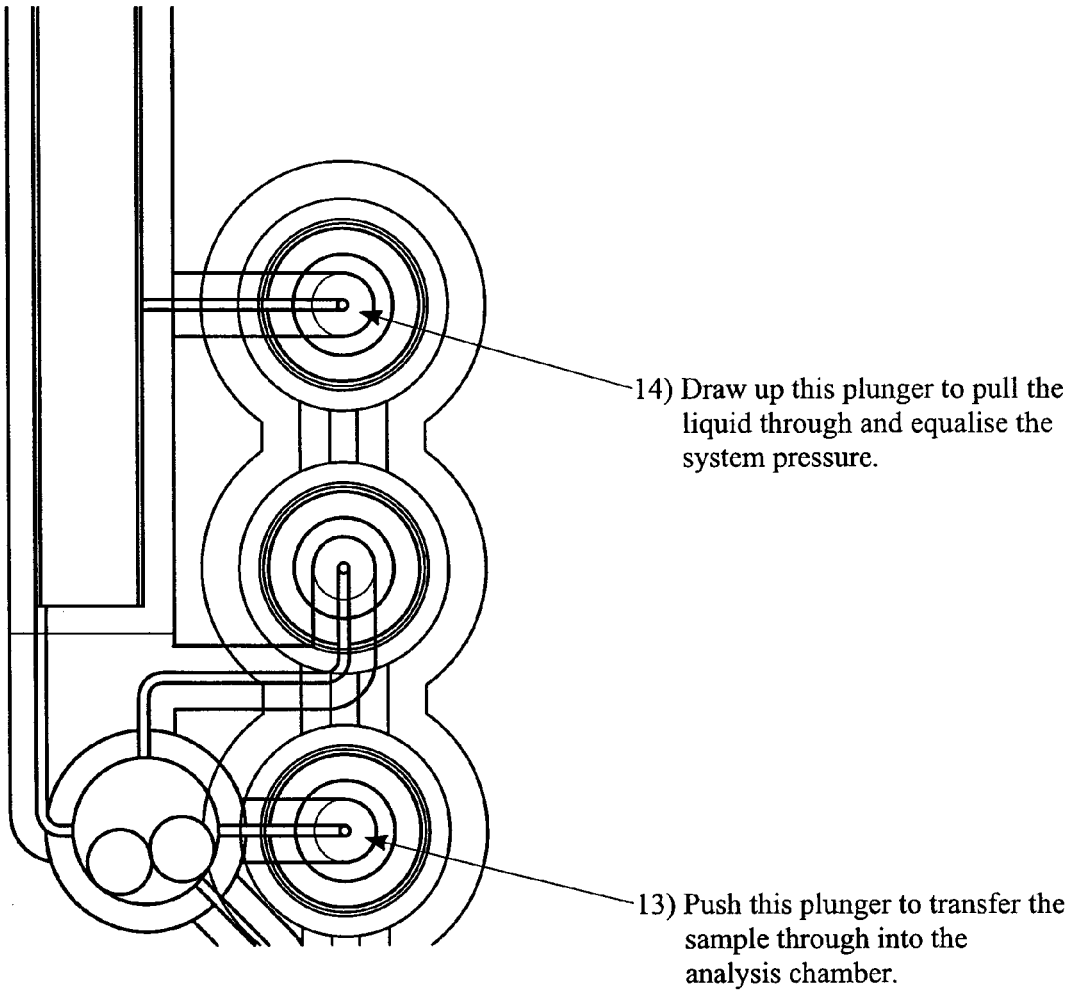
Figure 17:
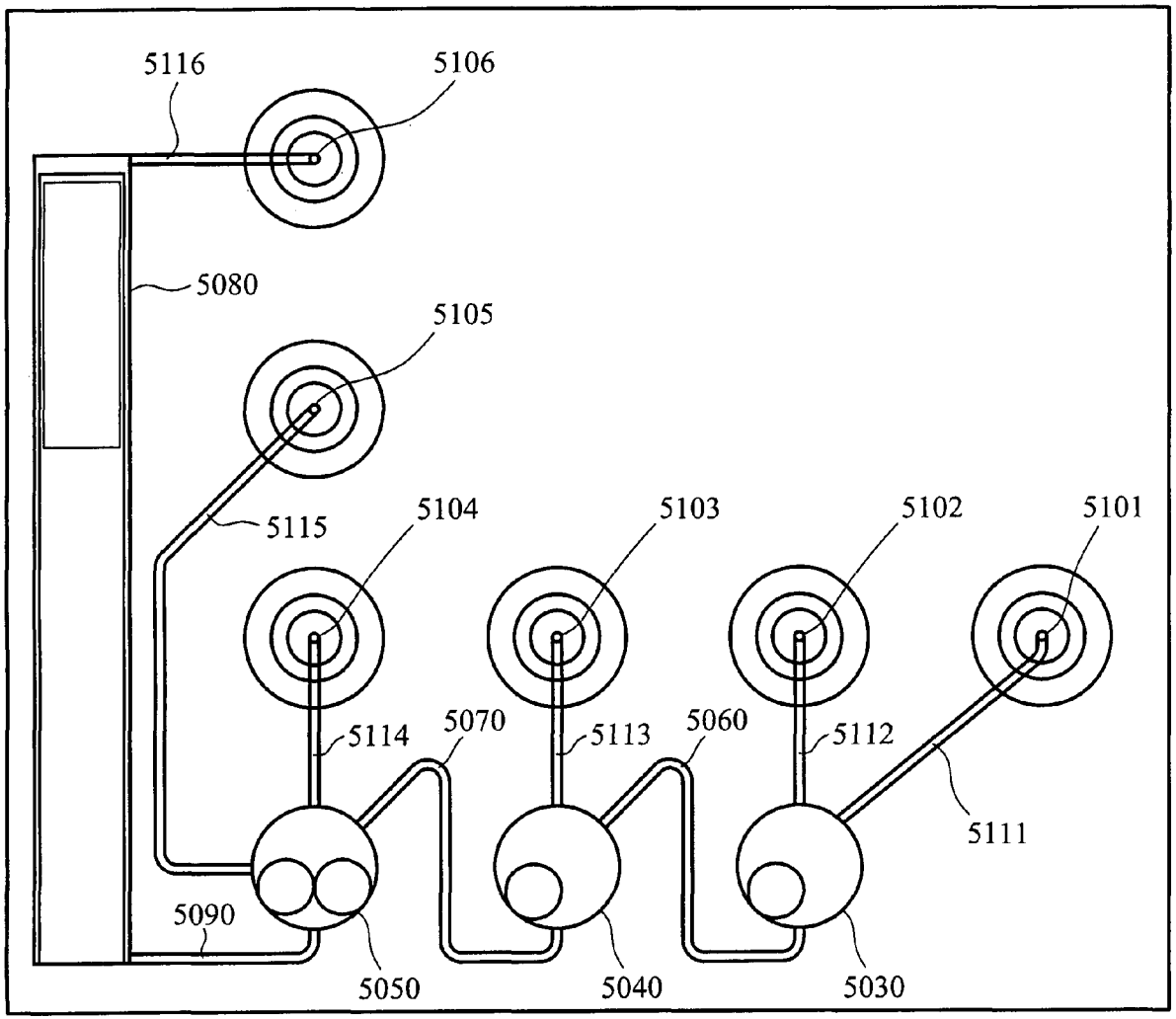
Figure 18:
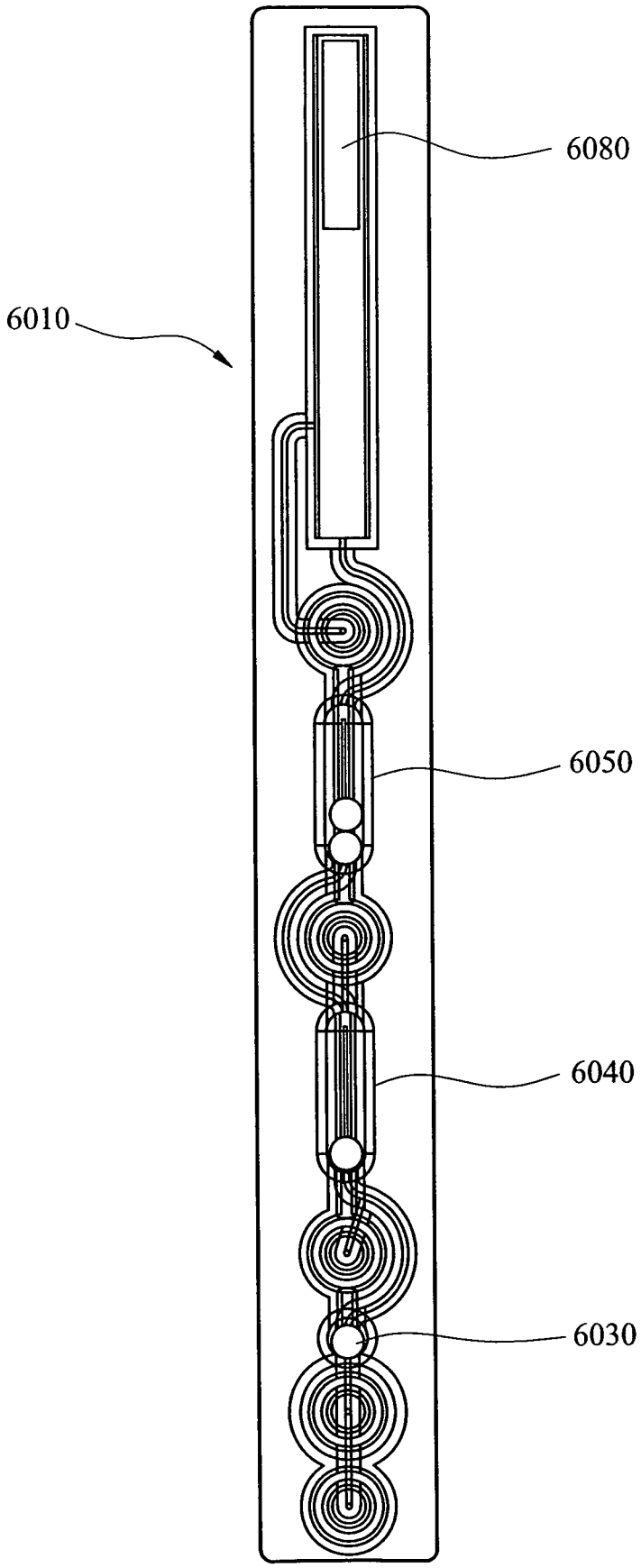
Figure 19:
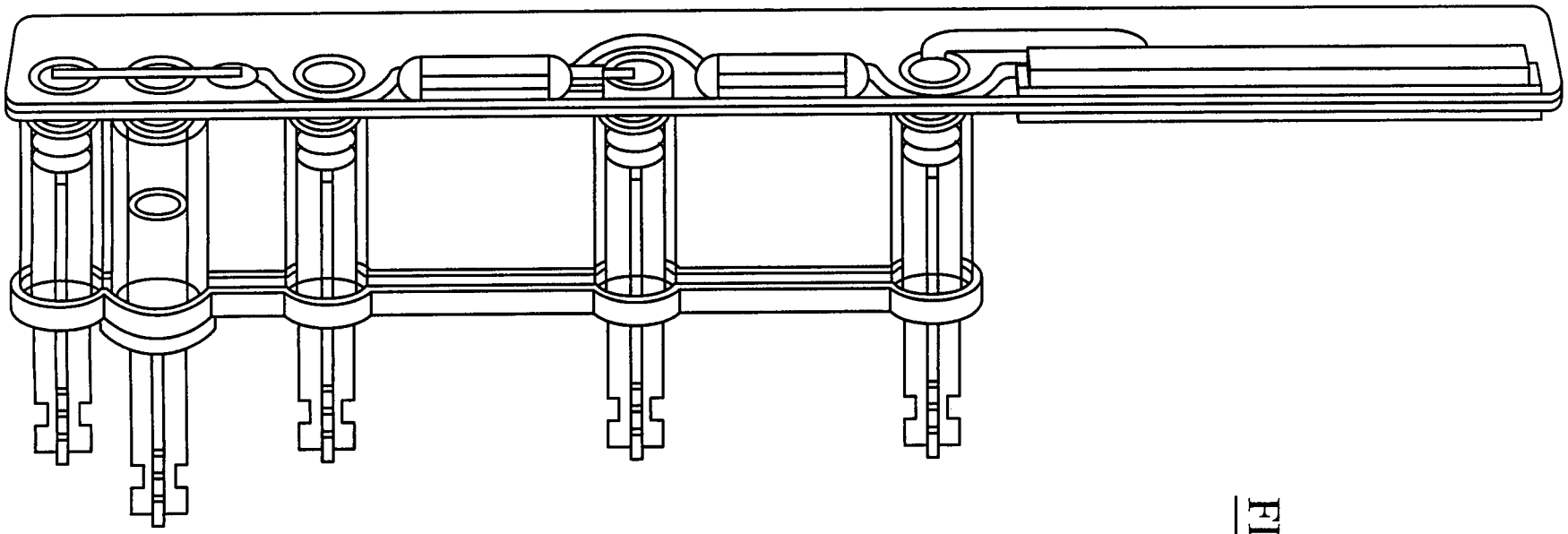
Figure 20:
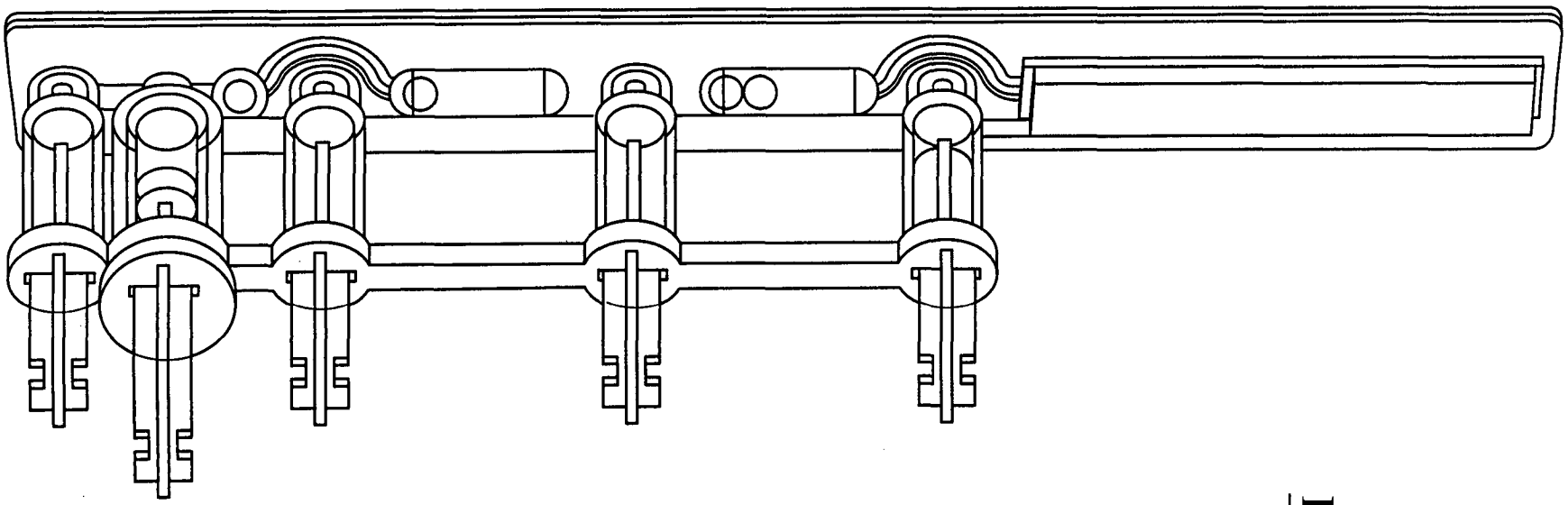
Figure 21:
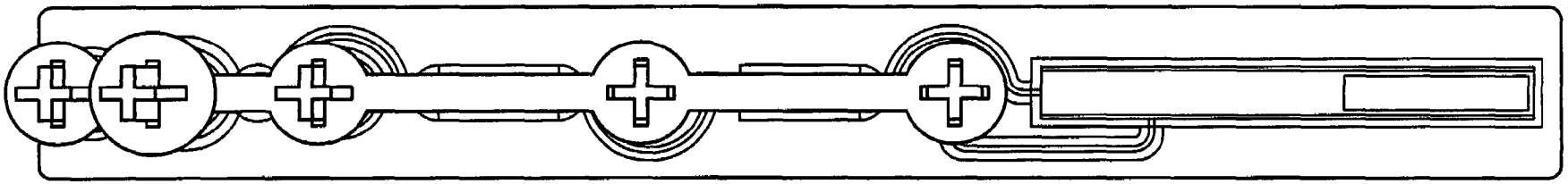

Specific embodiments of the invention will now be described by way of example, with reference to the drawings in which;

FIG. 1A is a device according to a first embodiment of the invention viewed from above, FIG. 1B is a device according to FIG. 1A viewed from below, FIG. 1C is a plan view of the device of FIG. 1A, FIG. 1D is a section view along the line A-A as shown in FIG. 1C, FIG. 1E is a projection view of a seal element used in the device of FIG. 1A, viewed showing v-ring profile sealing ridges, FIG. 1F is a plan view of the seal element of FIG. 1E, FIG. 1G is a section view along the line D-D as shown in FIG. 1F, FIG. 2 is an exploded view of the device according to a first embodiment of the invention, FIG. 3 is a flow chart illustrating the method steps involved in performing an assay using a device according to the invention, FIG. 4A is a three-quarter view of a device according to a second embodiment of the invention with its processing chamber in a position to receive a sample, FIG. 4B shows the device according to the second embodiment of the invention with the processing chamber sealed within the device housing, FIG. 4C shows the device according to the second embodiment of the invention with the processing chamber positioned beneath an opening of a first reagent chamber, FIG. 4D shows the device according to the second embodiment of the invention with the processing chamber positioned in an incubation position between the first and second reagent chambers, FIG. 4E shows the device according to the second embodiment of the invention with a test strip analysis means coming into contact with the sample in the processing chamber, FIG. 5A illustrates a couplable reagent chamber suitable for containing a liquid reagent, FIG. 5B illustrates the couplable reagent chamber of FIG. 5A after actuation to release its contents, FIG. 6A is a three-quarter view of a device according to a third embodiment of the invention, FIG. 6B is an exploded view of the device of FIG. 6A, FIG. 7 is a perspective view of a device according to a fourth embodiment of the invention, viewed from the side, FIG. 8 is a perspective view of the device according to the fourth embodiment of the invention showing the test plate and the plunger plate uncoupled, FIG. 9 is a cutaway side view of the device of FIG. 7, showing processing chambers and capillaries in the test plate, FIG. 10 is an exploded view of the test plate of the device of FIG. 7, FIG. 11 is an exploded view of the plunger plate of the device of FIG. 7, FIG. 12 is a cutaway side view of a portion of the device of FIG. 7 illustrating a method of using the device of FIG. 7, FIG. 13 is a cutaway side view of a portion of the device of FIG. 7 illustrating a method of using the device of FIG. 7, FIG. 14 is a cutaway side view of a portion of the device of FIG. 7 illustrating a method of using the device of FIG. 7, FIG. 15 is a cutaway side view of a portion of the device of FIG. 7 illustrating a method of using the device of FIG. 7, FIG. 16 is a cutaway side view of a portion of the device of FIG. 7 illustrating a method of using the device of FIG. 7, FIG. 17 is a cutaway side view of a device according to a fifth embodiment of the invention, FIG. 18 is a cutaway side view of a device according to a sixth embodiment of the invention, FIG. 19 is a perspective view of the device according to FIG. 18, FIG. 20 is a perspective view of the device according to FIG. 18, FIG. 21 is a top view of the device according to FIG. 18.

A preferred embodiment of a device according to the invention is illustrated by FIGS. 1A, 1B, 1C, 1D, 1E, 1F, 1G and 2.

The device 10 comprises a substantially circular body, or location apparatus 20. The location apparatus comprises two portions, an upper portion 21 and a lower portion 22, both of which are circular and rotatably engagable with each other about a common central point.

The device further comprises first 30, second 40, and third 50 reagent chambers and an analyser chamber 100 depending from the upper portion of the location apparatus, and a processing chamber 60 depending from the lower portion of the location apparatus.

The lower portion has a downwardly-extending circumferential circular lip 23, whose lower edge acts as a stand for the device during processing. The processing chamber is positioned the circular lip at a fixed radius from the central point.

The upper portion has a slightly greater diameter than the circular lip of the lower portion. The upper portion has a downwardly depending skirt around its entire circumference that fits over and engages with the seal element and the circular lip of the lower portion, this engagement enabling the upper portion to be rotated relative to the lower portion about the common central point of both upper and lower portions.

The processing chamber has an opening 62 defined by an entrance 63. The entrance to the processing chamber 63 is arranged to lie in the same plane as, i.e. flush with, the upper edge of the circular lip. The processing chamber itself depends from the lower portion and is defined by processing chamber walls. A seal element is arranged such that it is fixed relative to the upper portion and, thus, is moveable relative to the lower portion.

The upper portion supports the first, second and third reagent chambers and the analyser chamber. Each of these chambers is associated with a respective opening defined in the upper portion at a fixed radius from the centre of the upper portion such that each opening may, when the upper portion has been rotated appropriately relative to the lower portion, overlap with the processing chamber opening. This allows communication between the processing chamber and each of the reagent chambers and the analyser chamber to be effected in turn.

Additionally the upper portion defines an access opening, or access port, 70 at a fixed radius from the centre of the upper portion such that it may overlap with the processing chamber opening. This access opening or access port is covered with a removable foil seal 80 to prevent contamination of the device by the external environment prior to use. When the device is ready for use the access opening in the upper portion is aligned with the processing chamber in the lower portion.

A seal element 90 comprises a disk of resilient material, e.g. rubber, having an upper and a lower surface. Six circular holes are defined through the thickness of the seal element and each hole is outlined on the upper surface by a square profile locating ridge 91 and on the lower surface by a v-profile sealing ridge, or v-ring 92. The entire circumference of the lower surface of the seal element is also bounded by a v-ring 92.

The v-ring abuts a planar surface of the lower portion, thereby forming a seal. Thus, the reagent chamber openings are accessible through associated openings in the sealing element and closed, or blocked, by the planar surface of the lower portion.

Rotation of the lower portion relative to the upper portion allows the processing chamber to move into overlapping relationship with each opening in turn. In doing so, communication is provided between each reagent chamber and the processing chamber in turn.

The seal element has holes defined through it that align with the respective openings in the upper portion. The ridges on the upper side of the seal element mate with recesses defined in the upper portion to locate the seal element such that its holes align with the openings in the upper portion.

The seal element may have a different design to that illustrated in FIGS. 1A to 2. For example, the seal element may only define a single through-hole, which locates over the opening to the processing chamber and may, in this case, be fixed relative to the lower portion and movable relative to the upper portion.

In this case the seal element would act to block each of the openings in the upper portion until the upper and lower portions are rotated such that a particular opening is aligned with the processing chamber opening. As an example, if the processing chamber is brought into alignment with the first reagent chamber opening, the hole in the seal element also aligns with the opening of the first reagent chamber and the contents of the first reagent chamber, previously maintained in the first reagent chamber by the seal element, fall into the processing chamber.

The illustrated seal element utilises v-ring type seal profiles, however, other seal profiles such as o-ring profiles or a combination of different profiles could be used; for example, a v-ring could be used for the seal around the circumference of the seal element which acts to seal the device from the external environment and o-rings could be used for the internal sealing of the individual chambers within the device.

Other sealing mechanisms and methods could be used, for example based on variations of the Luer-lock, frit and bayonet, screw threads or plunger seals.

Rotation of the lower portion of the body, or locating apparatus, relative to the upper portion thus moves the processing chamber between six positions, or stations, each enabling a step in a processing protocol for which the device is designed. In a first position, the processing chamber is opposite the access port 70 for receiving a sample. In a second position it is opposite a blank section 25 of the upper portion, which acts to seal the processing chamber without adding any reagent, for an incubation processing step. In third, fourth and fifth positions the processing chamber aligns with the first 30, second 40, and third 50 reagent chambers for the delivery of reagents and in a sixth position it aligns with the analyser chamber 100. A ratchet apparatus (not shown) acts between the upper and lower portions of the locating apparatus to prevent rotation in a reverse direction and to locate the location apparatus in position during processing at each position or station. In alternative embodiments, any suitable number and arrangements may be defined in the upper portion of the locating apparatus depending on the processing protocol for which the device is designed.

The first reagent chamber 30 is in the form of a blister or cell defined by walls extending from the upper portion of the location apparatus, and contains a dried processing reagent. The processing reagent is contained in the reagent chamber by the reagent chamber's walls and the seal element, which blocks the opening associated with the first reagent chamber.

The second reagent chamber 40 is a separately couplable chamber that contains a liquid reagent. The second reagent chamber couples to the upper portion at its associated opening by means of a bayonet fit. When coupled to the upper portion of the location apparatus, the liquid reagent within the second reagent chamber can be dispensed through its associated opening. As with the first reagent chamber, the seal element acts to block the opening until the opening is aligned with the processing chamber, at which point liquid from the second reagent chamber may be dispensed through the opening and through the processing chamber opening into the processing chamber.

FIGS. 5A and 5B illustrate a separately couplable reagent chamber 900 suitable for containing liquid reagents in a device according to a further embodiment of the invention. The couplable chamber defines an internal space 910 for containing a liquid reagent. A lower portion of the removably couplable chamber is adapted to enable a push-fit with the device at the chamber's associated opening defined in the device. (This is an alternative construction to the bayonet fit described in the first embodiment.) A stopper arrangement 930 includes a spigot 940 that extends through the internal space 910 and seals a hole 950 at the bottom of the internal space. When the stopper arrangement is lifted, as illustrated in FIG. 5B, the spigot 940 is removed from the hole 950. A vent 960 near an upper portion of the internal space allows air into the internal space, thus displacing any liquid contained in the internal space through the hole 950. The vent is arranged so that the air is drawn from within the sealed device and not from the external environment, to reduce any risk of contamination during processing.

Alternative methods for liquid reagent delivery could be used, for example by syringe attached to the device via a Luer-lock or bayonet system.

The third reagent chamber is in the form of a blister defined by walls extending from the upper portion in the same way as the first reagent chamber defined above. The third reagent chamber contains dried reagents.

The analyser chamber is defined in and extends vertically from the upper portion. This analyser chamber is a tall, thin chamber for containing a test strip. The test strip is maintained in the analyser chamber by the sealing element in the same way as described above for dried processing reagents in the first and third reagent chambers.

The analyser chamber has a transparent wall to enable the test strip to be visually inspected.

The device of the embodiment is designed for on-site nucleic acid testing. In such a test, a blood sample must be processed by a number of steps to amplify the nucleic acid after which the processed sample is tested for the presence of a particular nucleic acid by use of a test strip. The closed system of the present invention is particularly advantageous to prevent contamination with rogue nucleic acids.

The following method for using the device relates to a method of amplifying and detecting a nucleic acid and refers to FIG. 3, a flow diagram illustrating the steps involved in nucleic acid testing.

A sample is collected from a patient and, in steps 1 to 3, is pre-processed prior to introduction into the device. The pre-processing steps can be any suitable pre-processing steps such as those currently known in the art for use with commercially available kits for nucleic acid extraction.

Simple pre-processing procedures may involve sample lysis by heat or chemical treatment and sample dilution prior to amplification. These are especially applicable for sample types that have high copy numbers of target nucleic acids e.g. ribosomal RNA present in thousands copies/cell.

The sample is added to a lysis buffer (step 1) and incubated (step 2). The sample is then diluted with a suitable buffer solution (step 3).

The device is prepared by coupling the separately couplable reagent chamber 40 containing a detection buffer to the upper portion of the location apparatus 20.

The foil seal 80 sealing the access port 70 is removed and pre-processed sample is introduced through the access port into the processing chamber 60 (step 4). The processing chamber contains a pre-loaded first freeze-dried reagent. The upper portion of the location apparatus is then rotated relative to lower portion and the processing chamber so that the processing chamber moves away from the access port and seals within the body, aligned with the blank section 25 of the upper portion, and the device is then shaken to mix the first freeze-dried reagent with the sample.

The device is then positioned on a heat source comprising a heating block shaped to receive the base of the processing chamber, and the sample within the chamber is incubated (step 5).

The device is removed from the heat source and the upper and lower portions are rotated relative to each other until the processing chamber opening overlaps with the opening associated with the first reagent chamber 30, which contains a second freeze-dried reagent. The second freeze-dried reagent falls into the processing chamber (step 6).

The device is again positioned on the heat source and incubated before being removed from the heat source (step 7).

The upper and lower portions of the location device are rotated further until the opening of the processing chamber aligns with the opening associated with the second reagent chamber. The couplable second reagent chamber has a stopper arrangement that needs to be removed so that its liquid detection buffer contents can flow into the processing chamber. The stopper is removed and the detection buffer is added to the processing chamber (step 8).

The upper and lower portions of the location device are rotated further until the opening of the processing chamber aligns with the opening associated with the third reagent chamber, containing third and fourth freeze-dried reagents. These reagents are added to the processing chamber (step 9).

The upper and lower portions of the location device are rotated to a final position in which the processing chamber opening overlaps with the opening associated with the analyser chamber containing a test strip. The test strip drops into the processing chamber so that its end is in contact with the processed sample (step 10).

The processed sample is wicked up by the test strip (step 11).

The results of the test are obtained by reading a visual signal on the test strip (step 12).

There may be further steps involved such as a step to treat the sample after analysis to prevent contamination of the environment around the device and/or a step to dispose of the device.

FIGS. 4A-4E illustrate a second embodiment of a device according to the invention.

The device 200 has a location apparatus or body 270, within which a passage of rectangular cross-section is defined. Along an upper wall of the passage are positioned an access port 280, three reagent chambers depending from the location apparatus 220, 230, and 240, and an analysis chamber 250 also depending from the location apparatus. The analysis chamber contains a test-strip 255 for analysis of the processed sample. Between the access port and the first reaction chamber, and between the reaction chambers, blank sections of the upper wall of the passage provide mixing and incubating positions, or stations. The device further comprises a processing chamber 210 set or moulded within a rubber block, which fits sealingly within the passage with the processing chamber opening abutting the upper wall of the location apparatus, so that it is sealed from the external environment when within the location apparatus.

A push-rod or end-plunger 260 enables a user to propel the processing chamber along the passage within the location apparatus 270. A plunger-type dispenser 251 is also utilised to retain the test-strip within the analysis chamber until it is required. A ratchet apparatus could be used to prevent the push-rod from being withdrawn and to aid location of the processing chamber at any one of a number of positions or stations.

Initial access is provided to the processing chamber by the access port 280 after removal of a foil seal (not shown).

Each reagent chamber has an associated opening defined in the location apparatus 222, 232, and 242 through which reagent contained in the reagent chamber can pass.

The processing chamber is movable within the location apparatus relative to the openings associated with the reagent chambers. In the example illustrated in FIG. 4A reagent chambers 220 and 240 contain freeze-dried balls of reagent 221 and 241, and reagent chamber 230 contains a liquid reagent 231.

Each reagent chamber comprises a hollow tube with an opening at one end leading through the upper wall of the location apparatus. At the opposite end of each reagent chamber a plunger 225, 235, and 245 seals the opposite end of the chamber and is actuatable to introduce the respective reagent into the processing chamber through the reagent chamber opening, when the processing chamber opening is disposed in overlapping relationship with the particular reagent chamber opening.

In use, a sample is loaded into the processing chamber through the processing chamber access port. The push-rod is used to slide the processing chamber within the location apparatus to an incubation position 290, illustrated in FIG. 4B. In this position the processing chamber is sealed from the external environment.

After an incubation step, the processing chamber is moved into a position directly underneath the opening associated with the first processing chamber 220, in which its opening is in overlapping relationship with the first reagent chamber opening 222.

The plunger on the first processing chamber is pushed to deliver the ball of reagent 221 into the processing chamber (FIG. 4C).

The plunger is moved to a second incubation position 295 illustrated in FIG. 4D.

After the second incubation the processing chamber is moved directly beneath the opening 232 associated with the second reagent chamber 230. The plunger on the second reagent chamber is pushed to deliver the reagent contained within it 231 to the processing chamber.

The processing chamber is then moved directly beneath the third reagent chamber opening 242 and the plunger is pushed to deliver the reagent 241 contained in the third reagent chamber to the processing chamber.

The processed reagent is then moved, within the processing chamber, to a position directly beneath the analysis chamber 250 containing the test strip 255. The plunger on the analysis chamber 251 is pushed to allow the test strip to drop into the processing chamber and contact the processed sample (FIG. 4E).

A third embodiment of the invention is illustrated in FIGS. 6A and 6B and the same reference numerals are used for components as were used for the first embodiment illustrated in FIGS. 1A to 2 and described above. This third embodiment is the same as the first embodiment in all regards except that the analyser chamber is defined in a horizontal aspect on the upper portion of the location apparatus in order to help make the whole device more compact.

The device of the third embodiment is used in the same way as described above for the first embodiment except that the entire device must be rotated by 90 degrees to enable the processed sample to contact the test strip contained in the analyser chamber after the processing chamber opening has been brought into register or overlapping relationship with the opening associated with the analyser chamber.

An embodiment of a device according to the invention is illustrated by FIGS. 7 to 11, and exemplary method steps for using the device are illustrated in FIGS. 12 to 16.

The device as illustrated by FIGS. 7 to 16 has two portions; a first portion, or test plate 4010, within which a sample is processed and analysed, and a second portion, or plunger plate 4020, couplable to the test plate and supporting a number of syringes or plungers. Different plungers have different functions, for example one plunger may be used to introduce the sample to the test plate, one may be used to deliver a processing solution and others may be used to move the sample through the test plate, as described below. The test plate and the plunger plate are packed separately for storage and transportation and must be assembled before use.

In the preferred embodiment the test plate has first 4030, second 4040, and third 4050 processing chambers defined within it, these three processing chambers connected to each other in series by first 4060 and second 4070 connecting capillaries or conduits.

The internal diameter of the capillaries is such that aqueous liquid can be moved through the capillaries on the application of pressure. The capillaries should not be too small as this could physically disrupt the sample but not too large as this may allow too much airflow around the system both in use and during incubation. The length of the capillaries may also be important. If the tubes are too short then airflow may occur through the tubes during incubation and if the tubes are too long then the movement of the sample between chambers may be too difficult. A practical capillary tubing may have a 0.5 sq. mm cross-sectional area and a length between chambers of between 15 and 25 mm preferably about 20 mm.

The test plate also defines an analysis chamber 4080 connected to the third processing chamber by a third connecting capillary 4090. The analysis chamber has a transparent wall to allow a user to have visual indication of the results of an analysis performed within the chamber. A transparent wall may also allow automated reading of an analysis signal, for instance by an automatic test-strip reader.

First 4101, second 4102, third 4103, fourth 4104, fifth 4105, and sixth 4106 plunger ports, each of which is dockable or mateable with a nozzle of a plunger, are linearly arranged on one side of the test plate. Alignment of the plungers advantageously allows efficient packing of the device during shipping, and may allow for easier assembly when coupling the plunger plate to the test plate.

The first and second ports (4101 & 4102) are respectively coupled to the first processing chamber via first 4111 and second 4112 access capillaries. The third port is coupled to the second chamber via a third access capillary 4113. The fourth and fifth ports are respectively coupled to the third processing chamber via fourth 4114 and fifth 4115 access capillaries. The sixth port is coupled to the analysis chamber via a sixth access capillary 4116.

The device is supplied to the end user with the processing chambers pre-loaded with freeze-dried or lyophilised reagents and the analysis chamber pre-loaded with a test-strip. FIG. 10 illustrates an exploded view of the test plate showing freeze dried reagents 4120 associated with first, second and third chambers and a test strip 4130 associated with the analysis chamber.

The plunger plate 4020 comprises a frame 4200 supporting first 401, third 403, fourth 404, fifth 405, and sixth 406 syringes or plungers. Each plunger has a nozzle (411 to 416) that is couplable to a port on the test plate and the frame holds each plunger such that it is in alignment with its respective port (i.e. the first plunger engages with the first port, the third plunger with the third port and so on) when the test plate and the plunger plate are brought into engagement. The plunger plate also supports a guide ring 420 for guiding a second plunger 402 into alignment with the second port 4102. This second plunger is used to introduce a liquid sample into the first processing chamber via the second port and is not fixed to the plunger plate.

O-rings 4230 help provide a gas and liquid tight seal between each plunger on the plunger plate and its respective port on the test plate.

The first 401, third 403, fourth 404 and sixth 406 plungers contain a gas, preferably air. The fifth plunger 405 is pre-loaded with a liquid buffer for use in the processing of the sample.

As supplied, the test plate is pre-loaded with freeze-dried or lyophilised reagents and the plunger plate is pre-loaded with a liquid buffer in the fifth plunger. The test plate and the plunger plate are brought together in a mating relationship (as illustrated in FIG. 7) such that each plunger's nozzle forms a seal with its respective port.

To use the device the test plate and the plunger plate are first engaged. Preferably, the mating relationship between the test plate and the plunger plate is a locking mate that cannot be broken once made. This may ensure a secure containment of the contents of the device during processing. Then, a liquid sample is loaded into the second plunger 402 and this plunger is then coupled to the device, through the guide 420 in the plunger plate, so that it engages with the second port 4102 on the test plate. All of the access ports are now blocked by plunger nozzles and the processing chambers (4030, 4040, and 4050) of the device are, thus, sealed from the external environment.

Advantageously, both the test plate and the plunger plate may have seals, for example foil seals, over the openings/mating parts to prevent contamination. Such seals would need to be removed before fitting the two plates together.

With reference to FIG. 12, the sample is added to the first processing chamber 4030 by actuating the second plunger 402 and simultaneously drawing up the third plunger 403 so that the sample is forced through the second port 4102 and through the second access capillary 4112. The sample hydrates the dried reagent contained in the first processing chamber and is then mixed by a combination of pushing and pulling on the second and third plungers (402 and 403). Drawing, or pulling, the third plunger while simultaneously pushing the second plunger causes a pressure differential to form biasing the sample in the first processing chamber 4030 along the first connecting capillary 4060 towards the second processing chamber 4040. Before the sample has reached the second processing chamber the third plunger is pressed and the second plunger drawn to draw the sample back into the first processing chamber. Repeating this push/pull of the second and third plungers causes a turbulent flow, back and forth, which helps to mix the sample and the reagent together.

When the sample has been sufficiently mixed, and after any further processing steps such as an incubation period have been carried out, the sample is moved to the second processing chamber 4040 by actuating the first plunger 401 and, thus, forcing the liquid sample through the first connecting capillary 4060 towards the second chamber while simultaneously drawing the third plunger 403 (FIG. 13). The sample is then mixed with reagent in the second chamber by a simultaneous push/pull action on the first and third plungers.

When the sample has been sufficiently mixed, and after any further processing steps such as an incubation period have been carried out, the sample is moved to the third processing chamber 4050 by pressing the third plunger and forcing the liquid sample through the second connecting capillary 4070 towards the third chamber while simultaneously drawing the fourth plunger 404 (FIG. 14). The sample is mixed with reagent in the third chamber by a simultaneous push/pull action on the third and fourth plungers.

The liquid buffer in the fifth plunger 405 is added to the third chamber, via the fifth port 4105 and the fifth access capillary 4115, by actuating the fifth plunger and drawing the sixth plunger to equalise the pressure (FIG. 15). As before, mixing of the sample and the buffer is achieved by a push/pull action on the appropriate plungers, in this case the fifth and sixth plungers.

After any further processing steps have been carried out the sample is transferred to the analysis chamber 4080 by actuating the fourth plunger 404 and the sixth plunger 406 to create a pressure differential that urges the sample through the third connecting capillary 4090 into the analysis chamber (FIG. 16). The, now processed, sample is wicked up by the test strip and the result can be seen visually through the clear walls of the analysis chamber.

In other embodiments the number and positioning of the plungers, the shape and alignment of the processing chambers and the length and direction of the capillaries may be varied to improve characteristics of the device such as the mixing of the sample with the reagents. Fifth and sixth embodiments of a device according to the invention are illustrated in FIGS. 17 to 21 using equivalent reference numerals for equivalent components as described for the fourth embodiment above; the difference being that the reference numerals start with a 5 or 6 respectively rather than a 4.

By way of example, the processing chambers in an embodiment of the device illustrated by FIGS. 18 to 21 are narrow and substantially cylindrical. This design may minimise gravitational effects on the sample. At the scale of the device, surface tension has a greater effect than gravity and cylindrical chambers may optimise performance in relation to surface tension. Furthermore, a cylindrical chamber may prevent the liquid sample from becoming 'stuck' as may occur when air is being pushed through a system with a more spherical processing chamber.

It may be possible to deliver a defined volume of liquid, for example the delivery of a defined volume of sample to the first processing chamber, by the introduction of an intermediary chamber with a defined volume coupled to an overflow chamber.

While the device according to the invention may be manually operated by a user the simplicity of the design may advantageously lend itself to automatic operation. In such a case the device could be used a cartridge in a machine designed to perform a test cycle automatically. A machine for this purpose would be programmed to actuate the plungers in a specific order depending on the desired processing protocol, and may include a heater to perform any incubation steps required.

The invention claimed is:

1. A device for the processing of a sample, comprising;

a location apparatus, a processing chamber for receiving the sample having an opening, one or more reagent chambers, each reagent chamber having an associated opening defined in the location apparatus, the processing chamber being movable relative to the one or more reagent chambers to enable sequential communication between the processing chamber and each reagent chamber, such that each reagent chamber communicates with the processing chamber when its associated opening is disposed in overlapping relationship with the processing chamber opening; and a sealing apparatus comprising a seal element which forms a circumferential seal around the opening of the processing chamber and the associated opening of each reagent chamber, which seals the processing chamber and the one or more reagent chambers from the external environment throughout movement of the processing chamber relative to the one or more reagent chambers, and throughout the communication between the processing chamber and the one or more reagent chambers, so that the sample cannot escape from the device during processing of the sample.

2. The device according to claim 1 in which the location apparatus comprises the sealing apparatus.

3. The device according to claim 1 in which the sealing apparatus seals the one or more reagent chambers from the external environment.

4. The device according to claim 1 in which the device is non-reusable.

5. The device according to claim 1 for processing a biological sample.

6. The device according to claim 1 further comprising an access port providing initial external access to the processing chamber opening to allow introduction of the sample.

7. The device according to claim 6 in which the access port is protected, prior to introduction of the sample, by a removable seal.

8. The device according to claim 1, in which the processing chamber is movable between a plurality of discrete positions or stations and in at least some of these positions the processing chamber opening is disposed in overlapping relationship with a reagent chamber opening.

9. The device according to claim 1 in which at least one of the one or more reagent chambers is couplable to the device.

10. The device according to claim 9 in which the, or each, couplable reagent chamber forms a seal when coupled to the device.

11. The device according to claim 1 having at least one dispenser actuatable to introduce a reagent from the one or more reagent chambers into the processing chamber.

12. The device according to claim 1 suitable for use with a freeze-dried or lyophilised reagent.

13. The device according to claim 1 suitable for use with a liquid reagent.

14. The device according to claim 1 in which the one or more reagent chambers are pre-loaded with reagents.

15. The device according to claim 1 in which the location apparatus comprises a bottom portion and a top portion movable relative to the bottom portion.

16. The device according to claim 1 further comprising an analyser chamber for containing an analyser for analysing the sample after processing, the analyser chamber having an associated opening defined in the device such that it communicates with the processing chamber when its associated opening is disposed in overlapping relationship with the processing chamber opening.

17. The device according to claim 16 in which the analyser chamber is pre-loaded with an analyser.

18. The device according to claim 16 in which the analyser is a test strip.

19. The device according to claim 16 in which a wall of the analyser chamber is substantially transparent.

20. A device according to claim 1, wherein the location apparatus comprises a lower portion and an upper portion, the portions being laterally movable relative to each other.

21. A device according to claim 1, wherein the location apparatus comprises a lower portion and an upper portion, the portions being rotatable relative to each other.

22. A device according to claim 1, further comprising:

a ratchet apparatus which acts to locate the processing chamber in position to enable the sequential communication between the processing chamber and the one or more reagent chambers, or to locate the processing chamber in discrete positions to enable the sequential communication between the processing chamber and each of the reagent chambers in tum.

23. A device according to claim 22, wherein the ratchet apparatus prevents movement of the processing chamber in a reverse direction through the device.

24. A device for the processing of a sample, comprising;

a location apparatus, a processing chamber for receiving the sample having an opening, a plurality of reagent chambers, each reagent chamber having an associated opening defined in the location apparatus, the processing chamber being movable relative to the reagent chambers to enable sequential communication between the processing chamber and each reagent chamber, such that each reagent chamber communicates with the processing chamber when its associated opening is disposed in overlapping relationship with the processing chamber opening; and a sealing apparatus comprising a seal element which forms a circumferential seal around the opening of the processing chamber and the associated opening of each reagent chamber, which seals the processing chamber and the reagent chambers from the external environment throughout movement of the processing chamber relative to the reagent chambers, and throughout the communication between the processing chamber and the reagent chambers so that the sample cannot escape from the device during processing of the sample.

25. The device according to claim 24 further comprising an analyser chamber for containing an analyser for analysing the sample after processing, the analyser chamber having an associated opening defined in the device such that it communicates with the processing chamber when its associated opening is disposed in overlapping relationship with the processing chamber opening.

26. A device for the processing of a sample, comprising;

a location apparatus, a processing chamber for receiving the sample having an opening, a reagent chamber having an associated opening defined in the location apparatus, the processing chamber being movable relative to the reagent chamber to enable communication between the processing chamber and the reagent chamber, such that the reagent chamber communicates with the processing chamber when its associated opening is disposed in overlapping relationship with the processing chamber opening; and a sealing apparatus comprising a seal element which forms a circumferential seal around the opening of the processing chamber and the associated opening of the reagent chamber, which seals the processing chamber and the reagent chamber from the external environment throughout movement of the processing chamber relative to the reagent chamber, and throughout the communication between the processing chamber and the reagent chamber, so that the sample cannot escape from the device during processing of the sample.

* * * * *